US005638666A

United States Patent [19]

Davidov

[11] Patent Number: 5,638,666

[45] **Date of Patent: *Jun. 17, 1997**

[54] DESK-TOP ENVELOPE MAKER

[75] Inventor: Gil Davidov, Haifa, Israel

[73] Assignee: G.D. Invention, Ltd., Haifa, Israel

[ * ] Notice: The term of this patent shall not extend beyond the expiration date of Pat. No. 5,426,915.

[21] Appl. No.: 479,525

[22] Filed: Jun. 7, 1995

Related U.S. Application Data

[63] Continuation of Ser. No. 31,899, Mar. 16, 1993, Pat. No. 5,426,915, which is a continuation-in-part of Ser. No. 934, 851, Aug. 24, 1992, abandoned.

[30] Foreign Application Priority Data

Mar. 17, 1992 [IL] Israel ..... 101264

[51] Int. Cl.[6] ..... B65B 11/48; B65B 61/00

[52] U.S. Cl. ..... 53/569; 53/55; 53/131.4; 53/206; 53/284.3; 493/216

[58] Field of Search ..... 53/569, 284.3, 53/206, 460, 411, 131.4, 131.2, 117, 116, 429, 55; 493/216, 100, 419, 420, 245

[56] References Cited

U.S. PATENT DOCUMENTS

| | | | |
|---|---|---|---|
| 2,694,351 | 11/1954 | Winkler et al. | 93/63 |
| 3,075,435 | 1/1963 | Mathews et al. | 93/73 |
| 3,265,382 | 8/1966 | Sherman | 270/45 |
| 3,845,698 | 11/1974 | Scholle | 93/61 R |
| 3,856,198 | 12/1974 | Daley et al. | 229/71 |
| 3,891,203 | 6/1975 | Schiff | 270/58 |
| 3,894,905 | 7/1975 | Ehlscheid | 156/384 |
| 3,995,847 | 12/1976 | Schiff | 270/58 |
| 4,067,171 | 1/1978 | Herbert et al. | 53/31 |
| 4,223,882 | 9/1980 | Stocker | 270/21 |
| 4,668,211 | 5/1987 | Lubotta et al. | 493/188 |
| 4,668,212 | 5/1987 | Kotani | 493/216 |
| 4,733,856 | 3/1988 | Gunther | 270/1.1 |
| 4,784,317 | 11/1988 | Chen et al. | 229/92.3 |
| 4,800,505 | 1/1989 | Axelrod et al. | 364/478 |
| 4,898,323 | 2/1990 | Chen et al. | 229/92.3 |
| 4,900,391 | 2/1990 | Mandel et al. | 156/364 |
| 4,924,652 | 5/1990 | Krasuski et al. | 53/55 |
| 5,048,809 | 9/1991 | Tebbe et al. | 270/45 |
| 5,054,757 | 10/1991 | Martin et al. | 270/45 |

FOREIGN PATENT DOCUMENTS

| | | |
|---|---|---|
| 2235000 | 1/1975 | France . |
| 2622558 | 5/1989 | France . |
| 2416247 | 10/1975 | Germany . |

*Primary Examiner*—James F. Coan
*Attorney, Agent, or Firm*—Greenblum & Bernstein P.L.C.

[57] ABSTRACT

The invention is directed to an apparatus and method for making an envelope from ordinary size, readily available, writing paper. Preferably, the apparatus is a compact desk-top size machine that can be combined with any common office printer, such as a laser printer, or even be incorporated thereinto to form a single machine. The apparatus enables the provision of a system for integrating and simplifying office computerized printing of letters and addressing of envelopes, by using a single paper tray whereby, for example, following the printing of a letter on one or more sheets of paper, the subsequently fed final sheet of paper from the paper tray is routed to the envelope making apparatus, perhaps after the printing of an address on the final sheet, whereby an envelope is created.

24 Claims, 26 Drawing Sheets

FIG. 18A
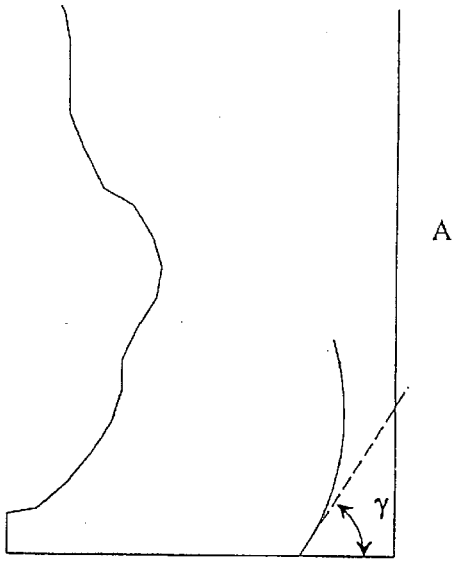
FIG. 18B
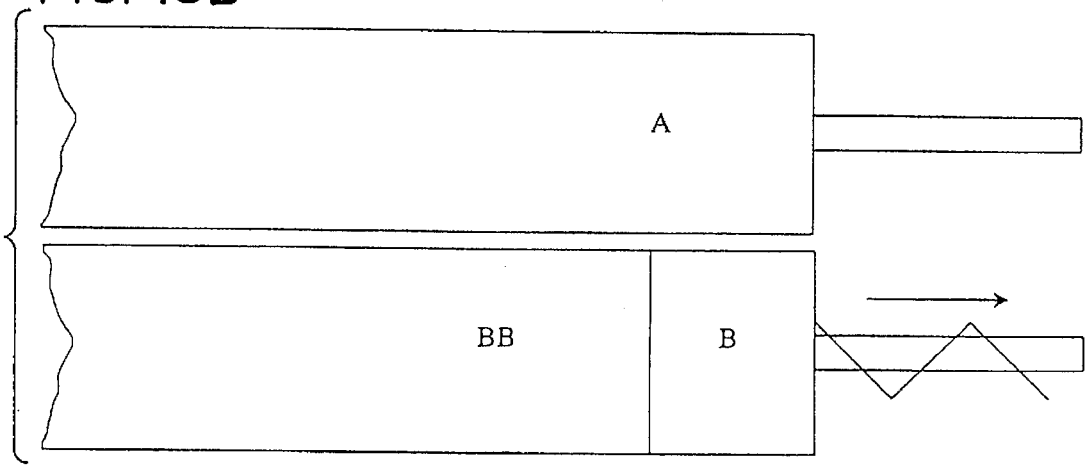
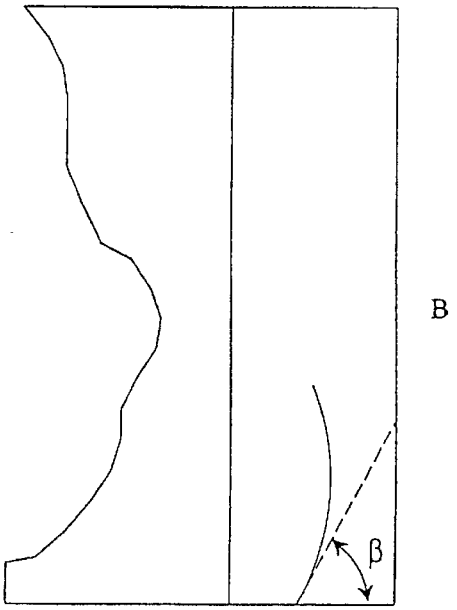
FIG. 18C

DESK-TOP ENVELOPE MAKER

CROSS-REFERENCE TO RELATED APPLICATION

This application is a continuation of application Ser. No. 08/031,899, filed on Mar. 16, 1993, now U.S. Pat. No. 5,426,915, which is a continuation-in-part of application Ser. No. 07/934,851, filed on Aug. 24, 1992 now abandoned, the disclosure of which is hereby incorporated by reference in its entirety.

BACKGROUND OF THE INVENTION

1. Field of the Invention

The present invention relates to a method and apparatus for making envelopes from ordinary size, readily available, sheets of writing paper. In a preferred embodiment, the apparatus can be combined with or incorporated into a printer for printing on the paper prior to its being made into an envelope.

2. Description of Background and Relevant Information

Most offices today are computerized, with typing done on a computer, such as a word-processor, linked to a printer. This considerably speeds-up the output of the office. However, a bottleneck frequently occurs at the stage of preparing the envelope for sending out material, such as the mailing of a printed letter. Most printers are not built to accept the infeed of envelopes for printing thereof, and it becomes necessary to revert to the typewriter for addressing the envelope. In the event that more than a few letters must be sent, the addressing of the envelopes can take a considerable amount of time.

Presently, there are several ways in which this problem can be overcome. These include the use of: (1) address labels; (2) envelopes with transparent windows; and special mechanisms for feeding envelopes into the printer.

All of these methods are expensive and/or time-consuming. A way is therefore needed to simplify the preparation of printed envelopes and to integrate their addressing into the computerized processes of the modern office in a simple and inexpensive manner.

SUMMARY OF THE INVENTION

It is an object of this invention to provide a compact desk top machine for making an envelope from ordinary size, readily available, writing paper.

It is a further object of this invention to provide a compact desk top envelope making machine that can be combined with any common office printer such as a laser printer.

Another object of the invention is to provide a method of making, addressing and printing envelopes using ordinary size paper generally available in offices, such as 8½ inch by 11 inch (US standard size), 8½ inch by 14 inch (US legal size) or A4 size paper, for example.

Yet another object is to provide a compact envelope making apparatus far combining with a printing apparatus in a single unit.

A still further objective is to provide a system for integrating and simplifying office computerized printing of letters and addressing of envelopes, by using a single paper tray.

Yet another object of the invention is to provide a method for integrating the letter and envelope addressing and graphics with the same computer program at the same time and with the same printing means.

In a specific embodiment of the present invention, there is thus provided a compact desk top apparatus for making envelopes from ordinary size writing paper, the apparatus including:

means for feeding and positioning a sheet of paper in the apparatus;

means for folding flaps;

means for applying adhesive to one or more flaps; and means for sealing the flaps and dispensing the envelope from the apparatus.

According to a particular embodiment of the invention, means are provided for cutting the sheet of paper in a predetermined shape of an unfolded envelope with a central section, a bottom flap section and a sealing flap section.

In a further embodiment, the apparatus also contains means for cutting the shape of two side flaps. The apparatus of the invention also comprises means for imprinting fold lines on the sheet of paper. A preferred apparatus comprises separate and distinct means for folding the side flaps and for folding the bottom flap.

A further feature of the apparatus is that the paper is fed into one side of the apparatus and the envelope is discharged from another side.

The apparatus of this invention can be used independently as a separate machine, it can be modularly connected to a printer for pre-typing on the paper to obtain ready-to-use pre-printed and/or addressed envelopes, and it can be built into a single housing together with a printer.

In a further embodiment, the apparatus can incorporate an arrangement for embossing a logo onto the paper so that, for example, the printed name and embossed logo of the sender will appear on the envelope. With this apparatus connected to a printer, there is no longer any need to buy envelopes or to type addresses on envelopes or labels, or to use transparent window envelopes. The apparatus according to this invention can be combined with different types of ordinary printers without having to adapt them with special envelope-feeding mechanisms.

Thus there is a significant economic saving in producing envelopes oneself from relatively inexpensive writing paper. With the apparatus according to this invention, it is also possible to make mailers from ordinary sheets of paper already carrying a message, thus saving the cost and bother of using and handling both a letter and an envelope.

According to the invention, ordinary size writing paper is fed into the apparatus from a standard single sheet dispensing paper tray or from a continuous zig-zag paper stack with a conventional tractor feed, for example. The sheet of paper may already have printing on it either on one or both sides before being fed into the apparatus.

The paper is fed into the apparatus and fold lines are impressed on the paper where required. Generally two fold lines are impressed, which define a bottom flap and a sealing flap.

In a particular aspect of the invention, means are provided for applying adhesive to the sealing flap. Adhesive is preferably applied in the paper feeding stage, but it may also be applied after positioning of the sheet of paper or at any other stage, such as when applying adhesive to the side or bottom flaps. The sheet of paper can then be positioned and held in place and cut to shape in the outline of an unfolded envelope. However, the paper may be cut to shape in the feeding stage or in any other stage before the folding of the flaps. The side and bottom flaps are then folded and two rollers press the folded flaps together between them. The edges of the envelope could be perforated at this point by an appropriate device if the envelope is to serve as a mailer. The pressing step may be accompanied by heating, depending upon the type of adhesive used. In that event, one or both of the rollers, for example, could be heated or other heating means could be added.

The envelope then emerges from the apparatus in a direction 90° displaced from its entry, ready for use. After the letter is inserted into the envelope, it is sealed by folding and pressing the sealing flap.

The apparatus of the invention can also be designed to enable feeding of paper from either or both sides of the apparatus by merely adding another set of rollers and adhesive applicators. This has advantages in that one side can be fed from a computer output and the other side can be fed either manually or from an independent paper tray.

The invention also includes a method of making an envelope in accordance with the aforementioned apparatus.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIGS. 18A–18C illustrate another alternative cutting apparatus;

DETAILED DESCRIPTION OF THE PREFERRED EMBODIMENTS

With reference to the drawings, it is to be understood that only enough of the construction of the apparatus of the invention for producing envelopes according to the present invention has been depicted therein, in order to simplify the illustrations for enhancing the understanding thereof and as needed for those skilled in the art to readily understand the underlying principles and concepts of the present invention.

Figure 1:
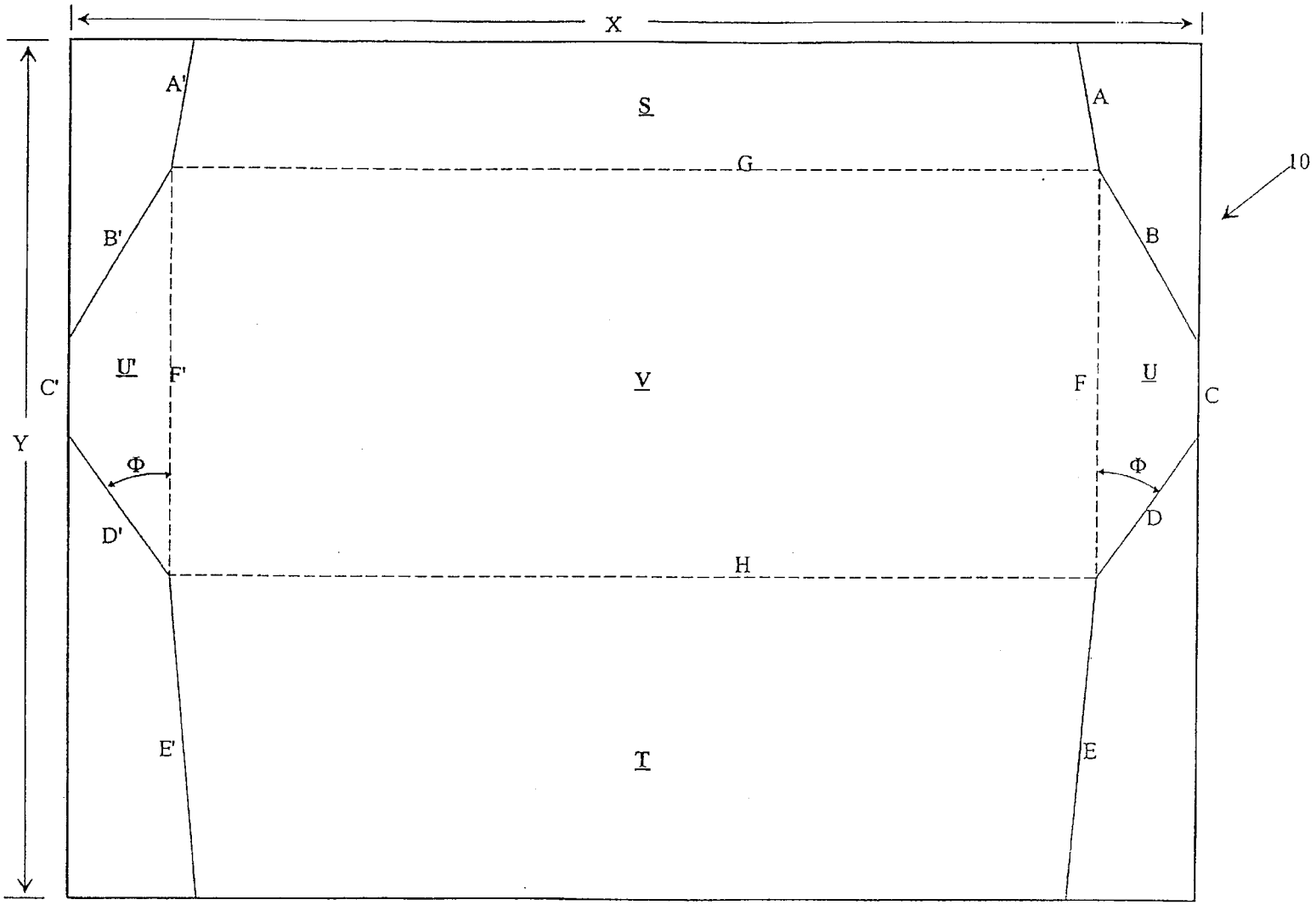
FIG. 1 illustrates an ordinary sheet of paper as an unfolded envelope with fold lines.

With initial reference to FIG. 1, there is illustrated an ordinary sheet of paper 10 for making an envelope in accordance with the invention, having a length X and width Y. The paper is preferably of a size that is conventional and readily available, because of its multiple purposes including, but not limited to, so-called "standard letter size", i.e., 8½ inches×11 inches, so-called "legal size", i.e., 8½ inches×14 inches, and so-called "A4" size, i.e., 21.0 cm×29.7 cm. That is, the invention is able to convert conventional, multi-purpose stock paper, unmodified for envelope formation, into an envelope. As will become readily apparent as the description proceeds, solid lines A, A', B, B', C, C', D, D', E and E' define the outline of an unfolded envelope, broken lines F and F' define imaginary folding lines and lines G and H define impressed or creased folding lines. These lines define the various areas of the envelope, such as the sealing flap S, the bottom flap T, two side flaps U and U' and a center section V.

A preferred size paper for use in this invention is one commonly available in offices, such multi-purpose stock paper including US standard or letter size (8.5×11 inches), A4 or folio, the US letter size being most preferred, due to the increased width. From such size paper conventional size envelopes can be prepared. However, any size paper can be used to prepare envelopes, as long as the apparatus is adjusted, instructed or programmed accordingly. In order to obtain satisfactory envelopes from such sheets of paper, it is important that the angle $\Phi$ formed by lines D and F and D' and F' be less than 90 degrees.

In general, it is possible to construct an apparatus in accordance with this invention suitable for making any predetermined size envelope, as long as the outline of the unfolded envelope fits on a sheet of paper that can be fed into the apparatus.

Figure 2:
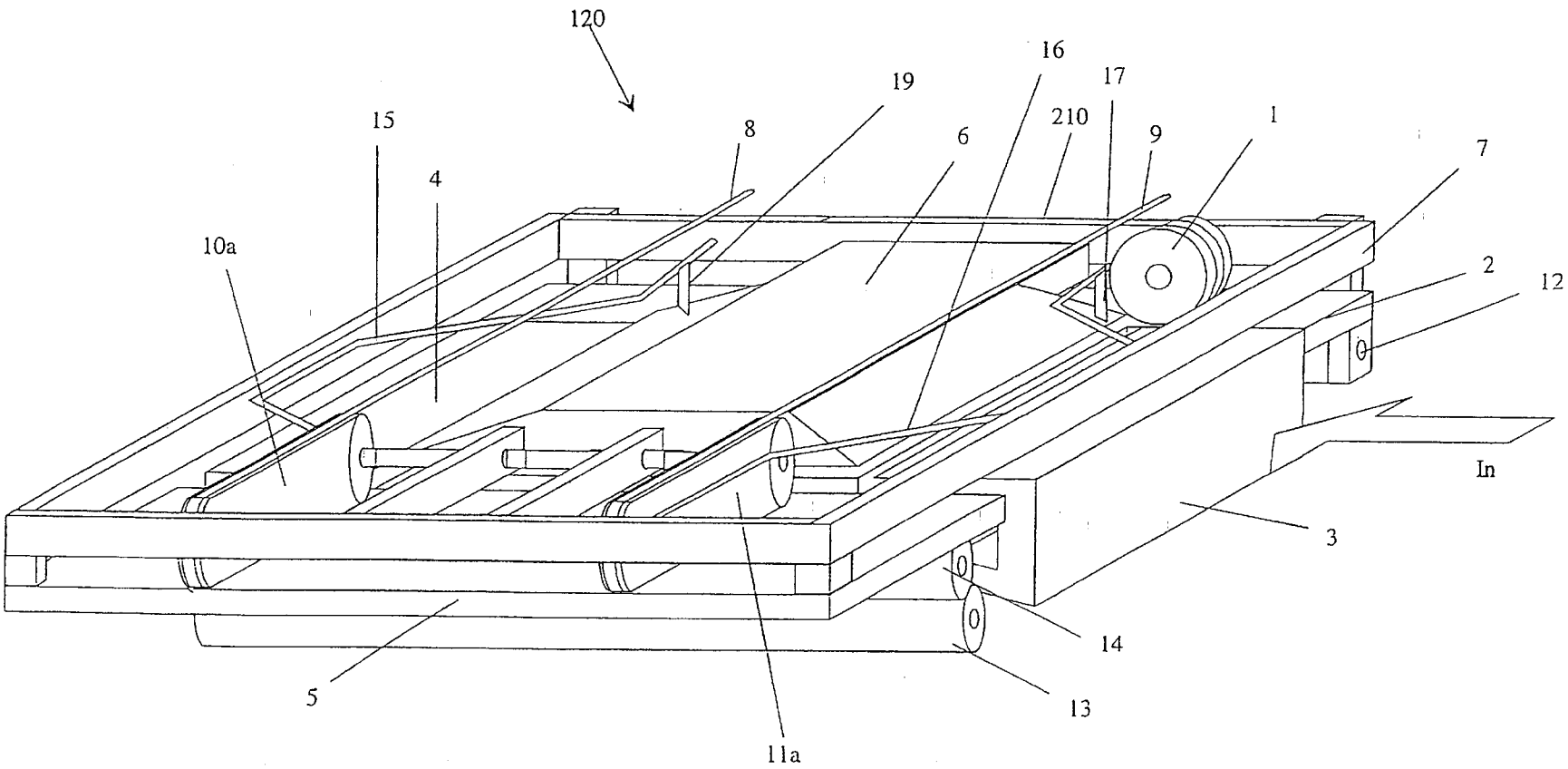
FIG. 2 is a front perspective view in accordance with a first embodiment of the invention in a position for receiving the sheet of paper before the envelope making process.

FIG. 2 illustrates in perspective view an apparatus in accordance with a first embodiment of the present invention at the beginning of its operation. In a second embodiment of the invention, further described below, certain parts of the apparatus are illustrated in somewhat greater detail. However, as will become apparent, certain of those details are applicable as well to the first embodiment.

Figure 20A:
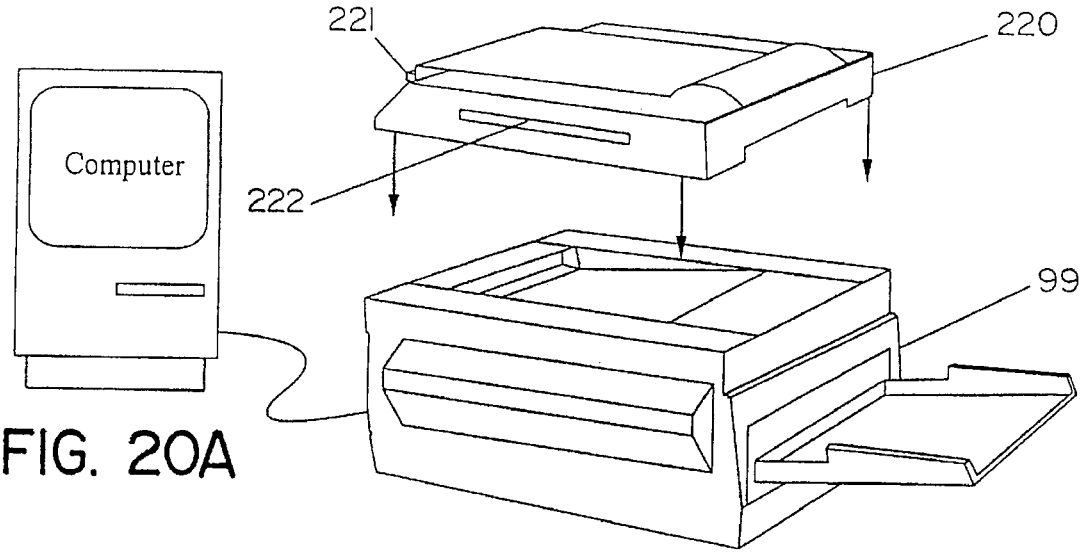
FIGS. 20A, 20B and 20C illustrate in perspective alternative embodiments of the apparatus according to the invention in association with a printer or a printing apparatus.
Figure 20B:
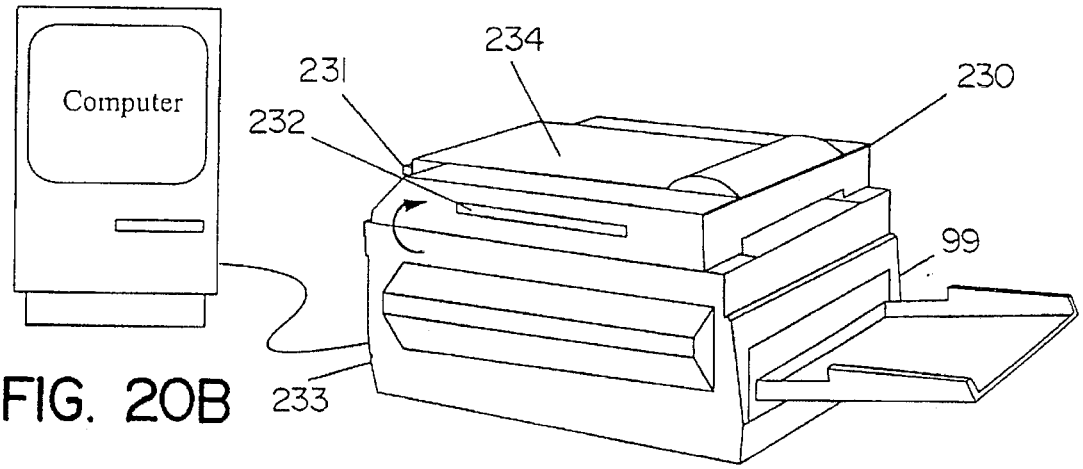
Figure 20C:
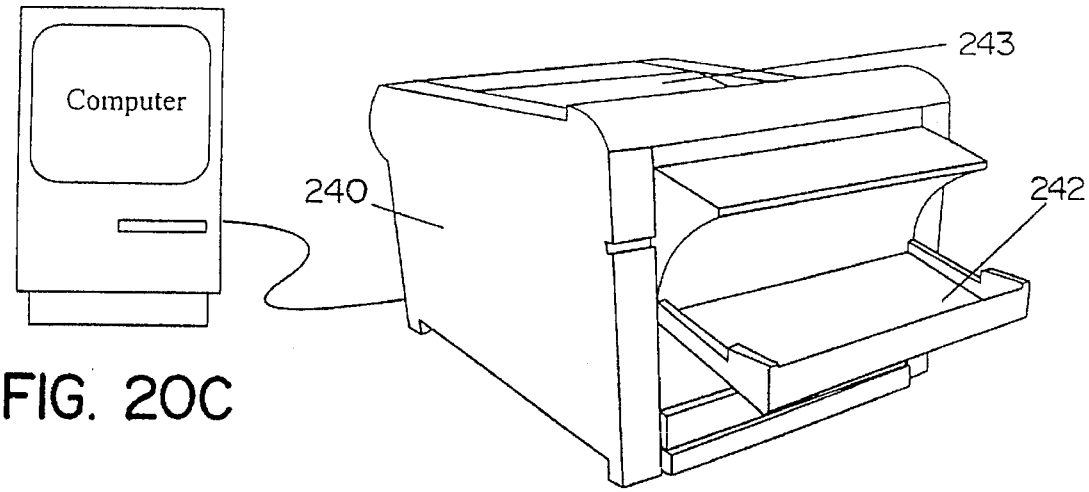

As described herein, the envelope maker of the invention is a self-contained apparatus, preferably a desk-top apparatus. FIGS. 20A–20C, further described below, are external views of certain embodiments of the apparatus, whereby the various mechanisms to be a described below are contained within the housing of the apparatus.

In FIG. 2, it can be seen that the apparatus 120 includes a frame 7, an upper pressure plate 6, two oppositely disposed side flap folding means or members 3 and 4 that are caused to move laterally toward and away from each other as further described below, a lower base or lower base plate 2, a bottom flap base 5, guide rails 15 and 16 to guide knife blades or edges 17 and 19 for cutting the sheet of paper in the shape of an unfolded envelope, and two strips 8 and 9 of double-sided release adhesive tape which are dispensed with the aid of guides 10*a* and 11*a*. Spring-biased rollers 13 and 14, which are biased and pressed against each other, receive and press closed the folded bottom flap of the envelope and dispense it from the apparatus.

Figure 3:
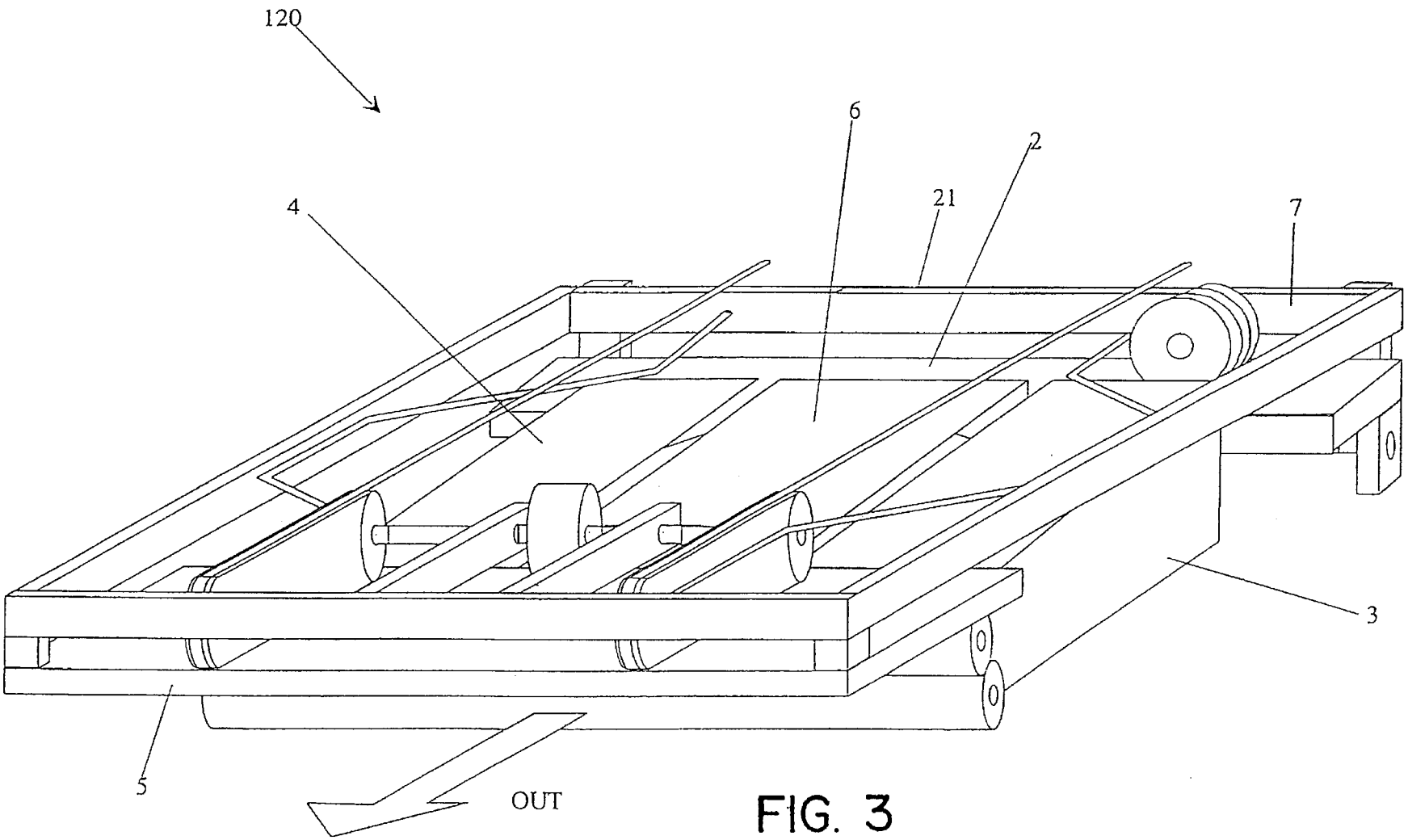
FIG. 3 is a front perspective view in accordance with the first embodiment of the invention in a position for discharging the sheet of paper during completion of the envelope making process.

FIG. 3 illustrates the same apparatus as in FIG. 2, but wherein it is shown in a stage or position at the end of the envelope making process. At this stage the lower base 2 and pressure plate 6 are in a lowered position with respect to frame 7, after having been forwardly pivoted about axle or shaft 12, and the side flap folding means 3 and 4 are advanced inwardly towards the center of the apparatus. The arrows labelled "in" and "out" in FIGS. 2 and 3 indicate the direction of entry of the paper and the direction of exit of the finished envelope, respectively.

Figure 4:
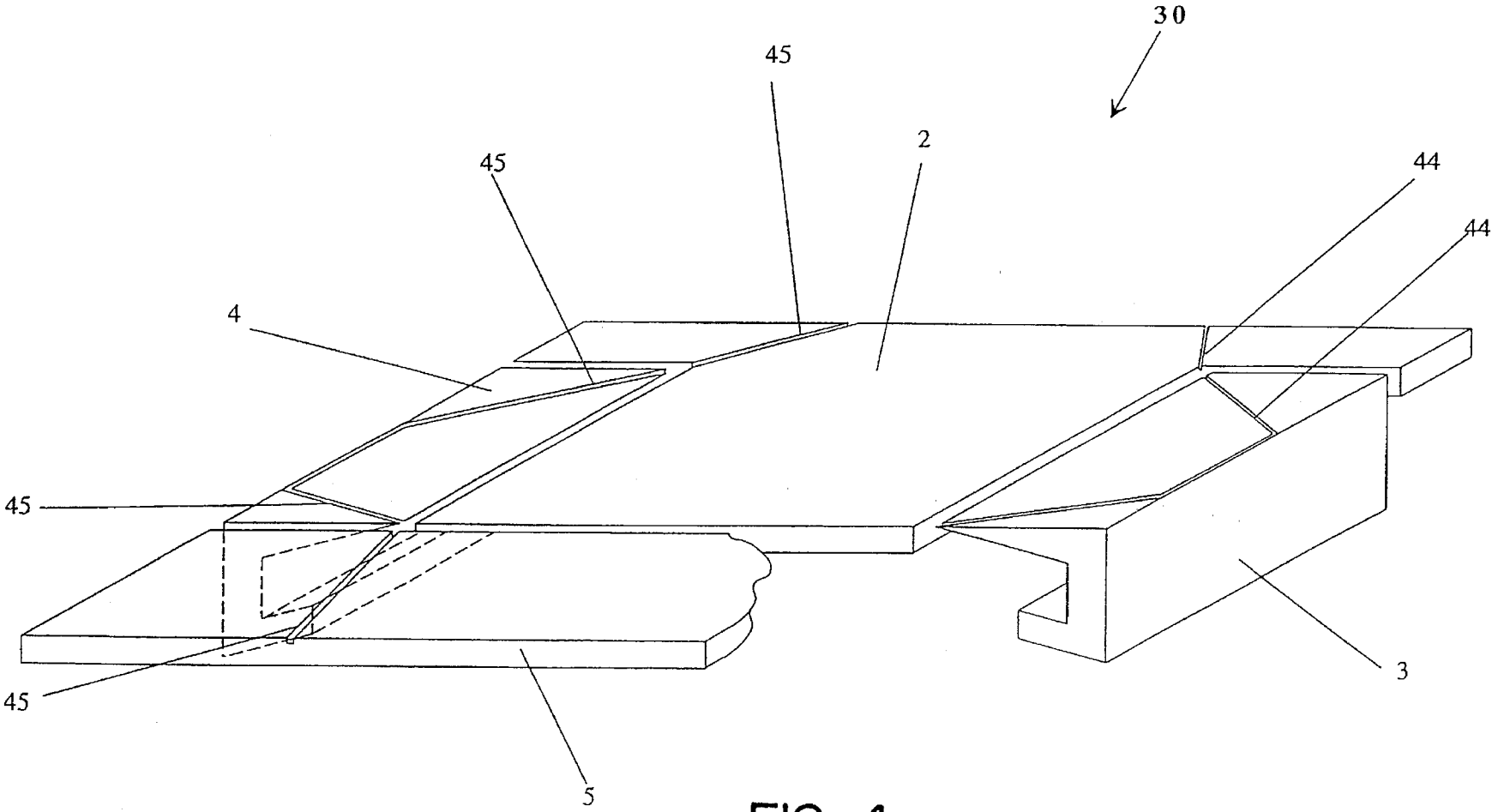
FIG. 4 is a schematic perspective view of a folding table of the apparatus according to the invention.

FIG. 4 is a schematic perspective view of a folding table 30, which is part of the apparatus 120 in FIGS. 2 and 3 and, because it is located below the upper pressure plate 6, it is substantially hidden from view therein. The folding table 30 comprises a lower base 2, the two side flap folding means 3 and 4 and the bottom flap base 5.

Figure 5:
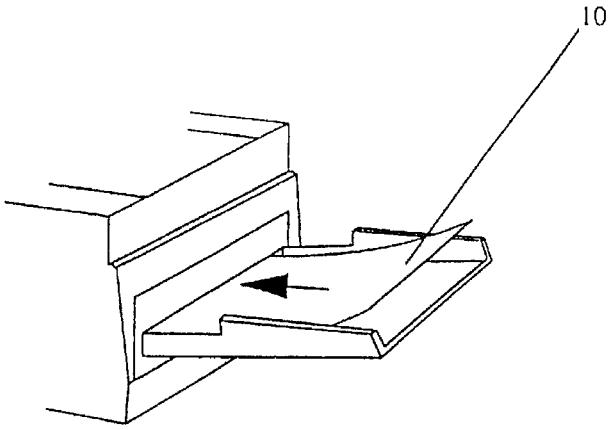
FIG. 5 shows a paper feeding tray that can be used with the apparatus of the invention.
Figure 6:
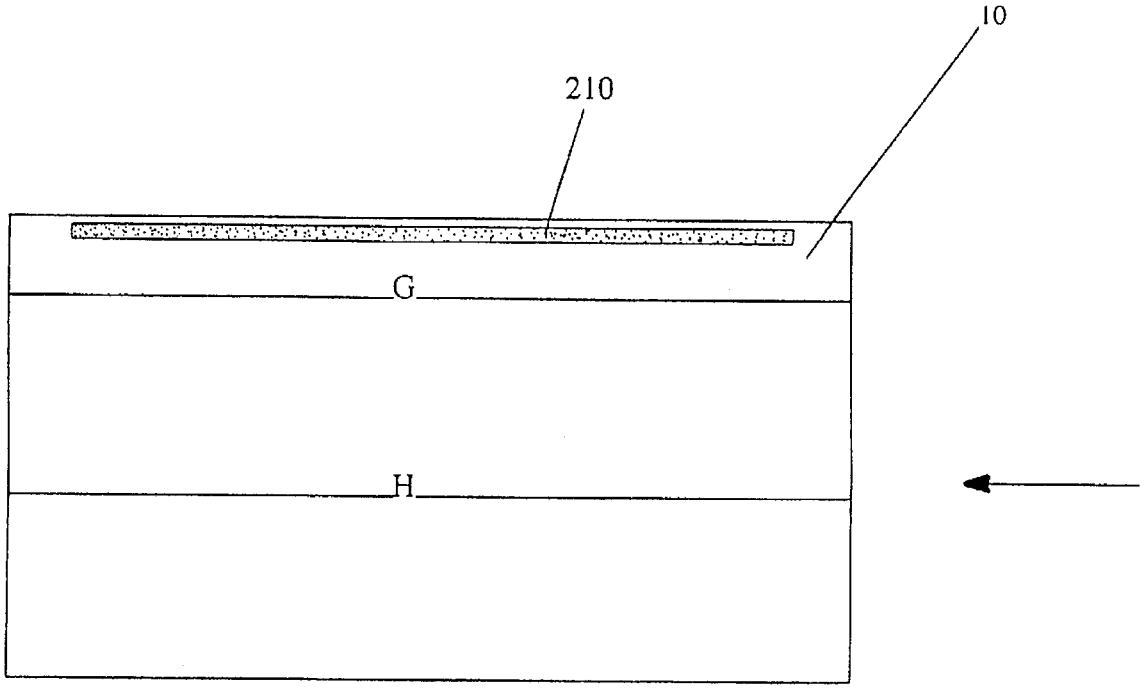
FIG. 6 illustrates a sheet of paper having an adhesive strip on a sealing flap and impressed or creased fold lines.
Figure 9A:
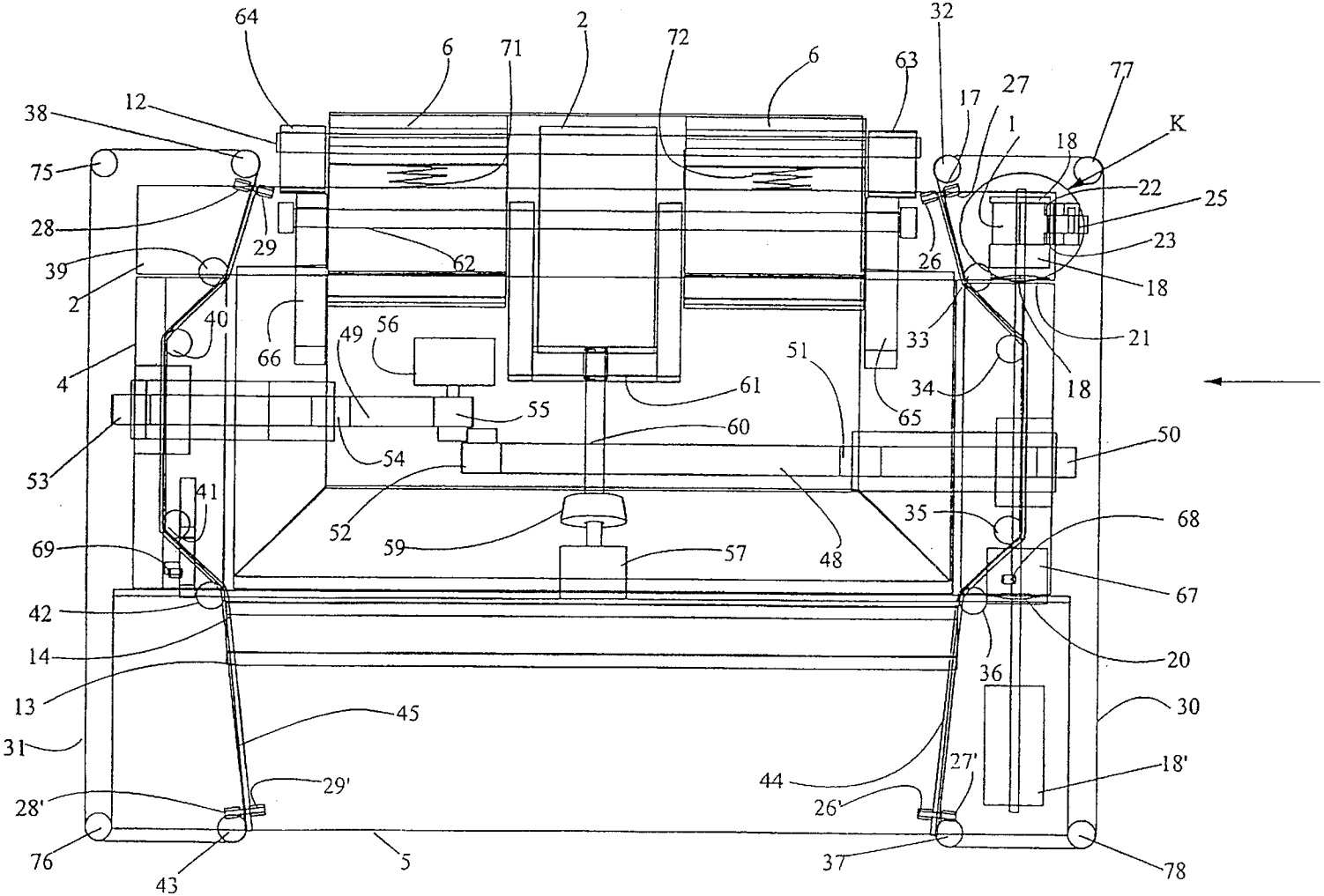
FIG. 9A is a detailed top plan view of a second preferred embodiment of the apparatus of the invention.

The apparatus described thus far operates as follows. Ordinary size paper 10 is fed into the apparatus from a tray T, for example, as illustrated in FIG. 5. When the paper enters the machine, two impression lines or creases G, H (see FIGS. 1 and 6) are made along the length of paper, which will subsequently serve as fold lines. These impressions are made by sharp rollers preferably stationarily mounted at the infeed to the machine so that the rollers press against the paper while the paper is fed into the apparatus. With regard to a further embodiment, these wheels 20, 21 are illustrated in FIG. 9A. These two impression lines G, H run along the entire length of the paper. At the same time, double-sided adhesive tape 210, with release paper on one side, is applied to the length of the paper, as illustrated in FIG. 6, and as will be further described below.

Figure 8A:
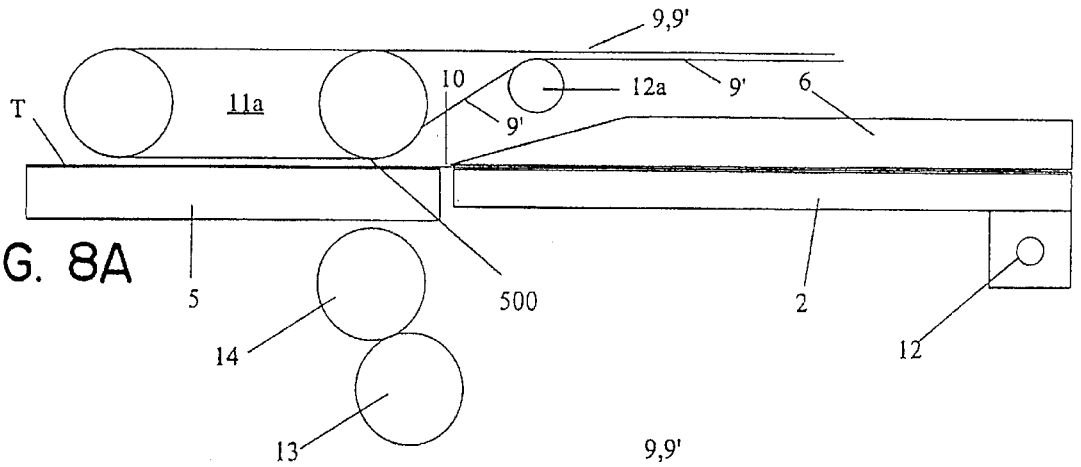
FIGS. 8A–8D schematically illustrate in side elevation the various stages of the folding process of the bottom flap according to the first embodiment of the invention.

After being completely infed to the machine, the paper is positioned on the folding table 30, illustrated in FIG. 4, table 30 being positioned beneath the pressure plate 6 of FIG. 2. The pressure plate 6 and frame 7 are then lowered to rest on the paper, exactly outlining the center section V and pressing the paper against the lower base 2 of the folding table which supports the paper. The frame 7 is now in a position above the paper and does not touch the paper in the area outlining the unfolded envelope. As the frame is lowered, two strips of double-sided adhesive tape 8, 9, being carried by a release paper or plastic backing 8', 9', which runs from dispensing rolls (not shown) and runs back to collecting rolls (not shown), are applied along edges E, E' of bottom flap T. As shown in FIG. 8A, the double-sided adhesive stuck to its release tape runs from right to left with the adhesive face up, around guide 11*a*, to point 500, which is the last point of contact between guide 11*a* and the paper 10. From point 500 the release tape runs back to the collecting roll via wheel 12*a* without the double-sided adhesive. This aspect of the invention is further described below.

The adhesive tapes 8, 9 with release paper backing extend, from right to left in FIG. 2, from respective dispensing rolls (not shown) and are trained along the upper portions of guides 10*a*, 11*a* and around the guides to the lower portions thereof, where engagement with appropriate portions of the sheet of paper is made as explained above. As will be explained below with reference to FIGS. 8A–8D, as the bottom flap is folded and the envelope is discharged from the apparatus, the folding table is lowered with respect to the guides 10*a*, 11*a*, thereby pulling the adhered adhesive strips 8, 9 away from guides 10*a*, 11*a* and away from their respective release tapes to the point at which adhesive strip segments, thus secured near edges E, E' of the envelope being made, are broken from the strips 8, 9. The release tape portions having had the adhesive removed, continue to be wound on respective recovery rolls or otherwise are advanced to a discharge area for recovery and disposal. The movement of the adhesive strips and release tape is caused by movement of the discharge of the envelope by means of the aforementioned pulling of the adhesive strips and release tape during such discharge.

After the pressure plate 6 is lowered onto base 2, the paper is then cut in the outline of the unfolded envelope by knife blades 17 and 19, which move along guide rails 15 and 16. The knife blades extend through the paper and the edges thereof are located about 2 mm. beneath the surface of the paper and move in slits 44, 45 found in the surfaces of the sections of the folding table 30 (see FIG. 4). Cuts are thus made in the sheet of paper at lines A, B, C, D, E and A', B', C', D', E'.

Figure 7A:
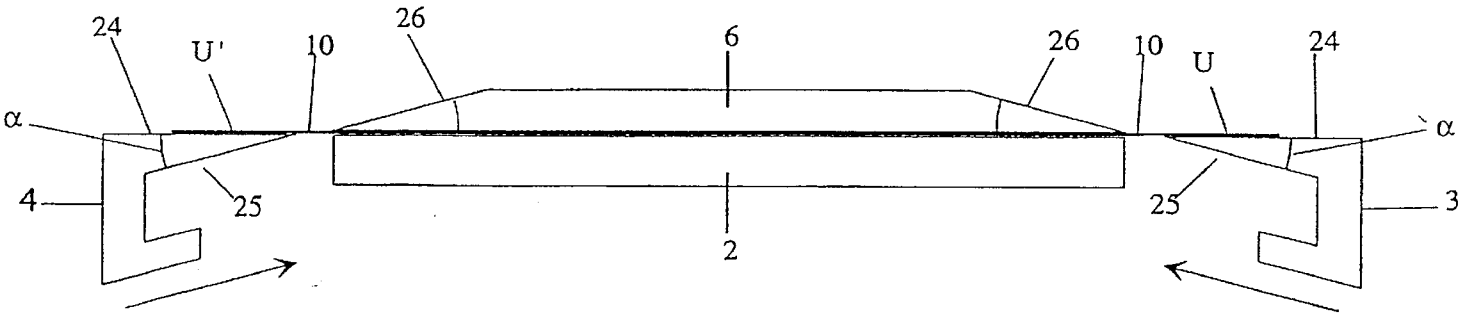
FIGS. 7A–7D schematically illustrate in front elevation the various stages of the folding process of the side flaps according to the first embodiment of the invention.
Figure 7B:
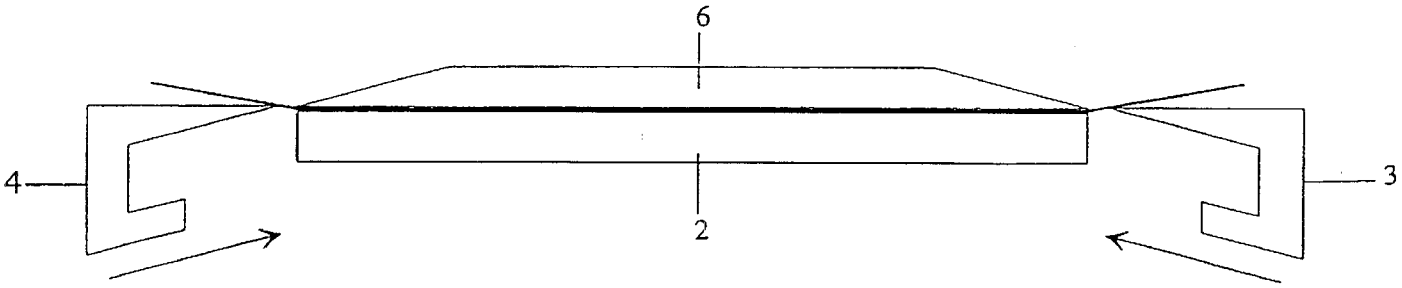
Figure 7C:
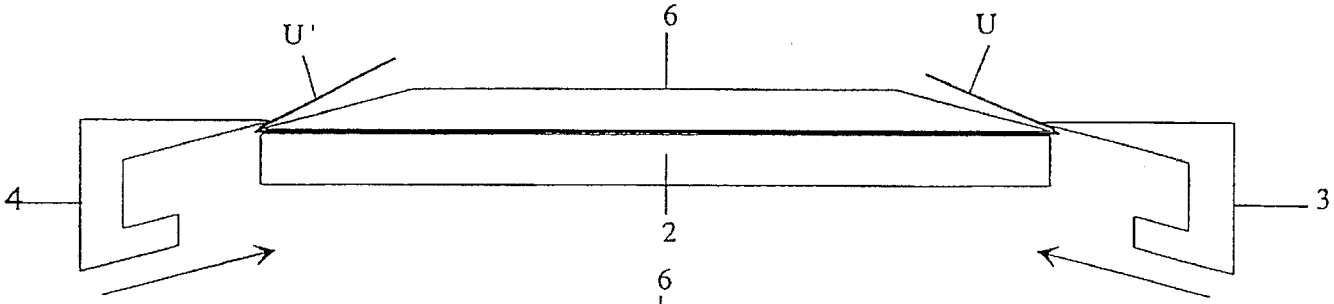
Figure 7D:
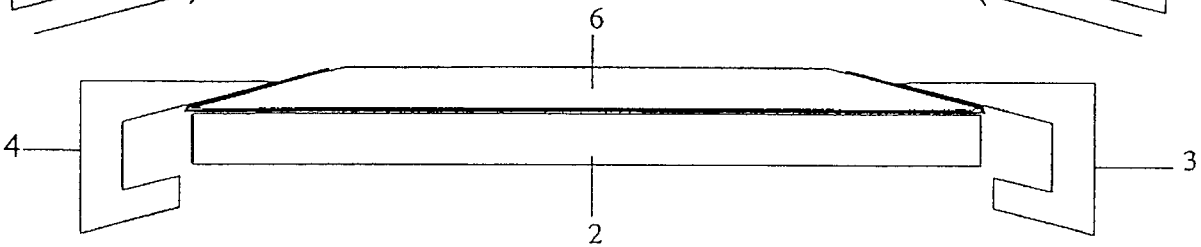

After the paper is cut into the shape of an envelope, the folding stage proceeds, whereby the side flaps U and U' are folded, as shown schematically in FIGS. 7A–7D. The sheet of paper 10 lies between the lower base plate 2 and upper pressure plate 6 with side flaps U, U' resting on the horizontal upper surfaces 24 of side flap folding members 3 and 4. The undersides or lower surfaces 25 of the upper surfaces 24 of side flap folders 3 and 4 are sloped at an angle $\alpha$. The side edges 26 of the upper pressure plate 6 also is at an approximate angle $\alpha$, so that when the side flap folders 3 and 4 move laterally towards the pressure plate 6, the side flaps U, U' lift up and fold over as the undersides 25 of side flap folders 3 and 4 slide over the sloped edge 26 of upper pressure plate 6. The upper pressure plate 6 thus determines the location of the fold lines and the side flap folders 3 and 4 do the actual folding. This process is illustrated in sequential stages in FIGS. 7A–7D, where FIG. 7D illustrates the position of the side flap folders 3 and 4 at the end of the process.

After the side flaps are folded, the bottom flap T, as shown in FIG. 1, is then folded as follows, as illustrated in FIGS. 8A–8D. By means of the folding of the bottom flap, the aforementioned adhesive strip segments, applied near fold lines E, E' engage and seal the bottom flap T over the side flaps U, U', as will become apparent. In a first stage shown in FIG. 8A, the cut-to-shape flat sheet of paper 10 rests on the lower base 2 and on the surface of bottom flap base 5 with the upper pressure plate 6 pressing down on the lower base 2. Further, the bottom flap is positioned immediately beneath the adhesive guide 11*a*, whereby the adhesive tape 9 is secured to the bottom flap near edge E. On the opposite side, not shown, adhesive tape 8 is secured to the bottom flap near edge E'.

Figure 8B:
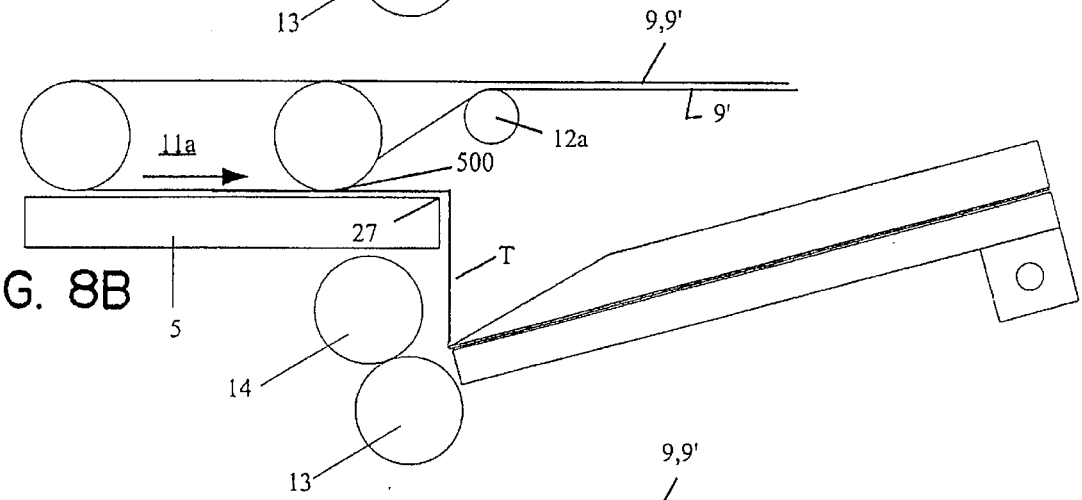

Then, as shown schematically in FIG. 8B, the assembly of the pressure plate 6, lower base 2 and members 3, 4 (not shown) is lowered pivotally about the axis of axle 12, causing the bottom flap T to be pulled from the upper edge 27 of bottom flap base 5. Such movement also pulls on the adhesive tape 9 in the direction of the arrow in FIG. 8B, together with the release tape 9' to which it is secured.

Thus, the pulling force is applied to the double-sided tape by bottom flap T. This pulling force is then applied by the double-sided adhesive to the release tape, which is much stronger than the double-sided adhesive, in way of a shear force. Then the force is applied by the release tape to the dispensing rolls and thereby overcomes the resistant force of the dispensing rolls, thereby causing the dispensing of the double-sided adhesive and attached release tape from the dispensing rolls. As the bottom flap T is pulled from beneath the guides 10*a*, 11*a*, between the stages of the folding operation shown in FIGS. 8B and 8C, the length of the double-sided adhesive which is adhered to the paper on one side and to the release tape on the other side becomes increasingly shorter. At point 500 when the bottom flap T is completely pulled from between member 5 and the guide 11*a* (and guide 10*a* on the opposite side not shown in FIGS. 8A–8D), the pulling force is exerted only to the relatively weak double-sided adhesive, which cannot overcome the resistant force of the dispensing roll, and a tear is thereby caused in the double-sided adhesive, thereby leaving respective adhesive segments near fold lines E, E'.

Figure 8C:
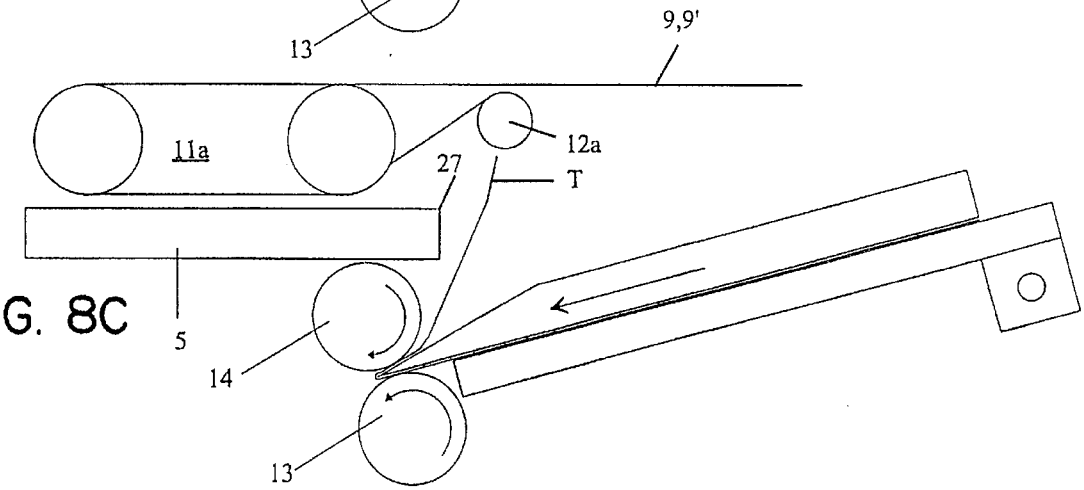

In the stage shown in FIG. 8C, the upper pressure plate 6 slides along the lower base 2 and forces the folded edge of flap T between spring biased rollers 13 and 14, which rotate in opposite directions. This rotating action pulls the folded edge of the bottom flap T forward, pressing the flap T against the side flaps U, U' and center section V. Using the withdrawn surface of the pressure plate 6 as a table top, the side flaps (see FIGS. 7A–7D) and the bottom flaps (see FIGS. 8A–8D) may be folded simultaneously or consecutively. The adhesive segments which are adhered to the bottom flap T then glue together the bottom flap T and the side flaps U, U'.

Figure 8D:
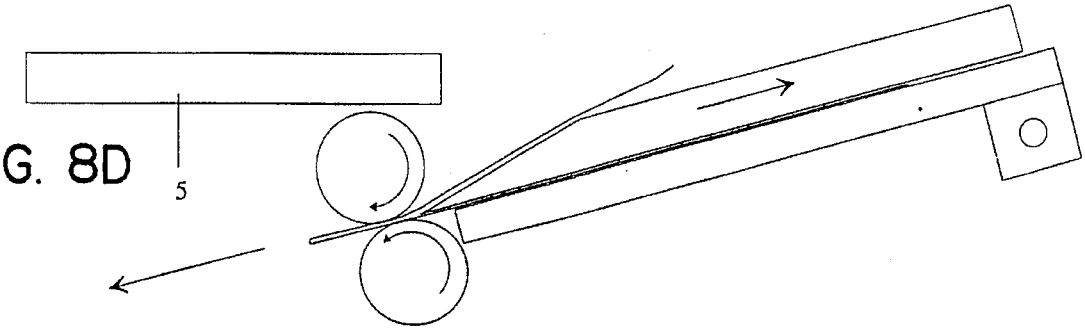

As the folded edge of the bottom flap T is pulled further through the rollers 13 and 14 in the stage shown in FIG. 8D, the upper pressure plate 6 withdraws to its previous position and the bottom flap T is sealed against the side flaps U, U' and central section V. The envelope continues to be conveyed by rollers 13 and 14 until it exits from the apparatus as shown in FIG. 3.

In addition to the apparatus and method as described above, it is contemplated that an embodiment could be provided whereby the cutting means and the means for folding side flaps are omitted, that is, the envelope would be created without side flaps. The creation of a standard envelope having side flaps, however, is preferred. Nevertheless, in such an embodiment, the lower base 2, the upper pressure plate 6 and the bottom flap base 5 would have the same length as the two fold lines G, H (see FIG. 1) that would extend the entire length of the sheet of paper. Further, the adhesive would be applied in the same manner as described above with reference to FIGS. 8A–8D, whereby the ends of the bottom flap T would be secured to respective ends of the central section V, instead of to the side flaps U, U'.

Other variations are also contemplated. For example, while still omitting side flaps and side flap folding means, an envelope could be produced with cutting means. In this manner, only the size of the envelope is changed by cutting. For example, the length of the sheet of paper or the width of the sheet of paper could be cut away. Still further, while still omitting side flaps and side flap folding means, merely the corners of the sealing flap S could be cut away, such as along lines A, A' shown in FIG. 1. Although this variation would still be less preferred than as previously described, the final envelope could by thereby given a somewhat improved appearance, for example. Other variations from those described are also intended to be covered within the scope of the invention.

Further, it is also contemplated that pre-cut sheets of paper, for example preformed in the shape described above, could be fed into the apparatus. However, a separate paper source, such as a separate paper tray, would be required to be affixed to the apparatus or to the printer when used in conjunction with a printer.

The invention will now be described in more detail with reference to a second preferred embodiment shown in FIGS. 9–14. The second embodiment shares most features and components with the first embodiment, as will be seen as the description proceeds. Further, certain particulars of the first embodiment which were not discussed in detail above for the purpose of clearly presenting other features of the first embodiment, are introduced below with regard to the second embodiment. However, the second embodiment differs from the first embodiment in certain respects, as will be seen, particularly with respect to the application of adhesives.

Figure 14A:
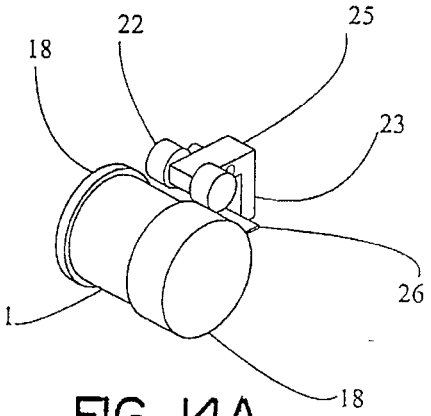
FIGS. 14A–14D are enlarged representations in perspective, side, front and top views respectively of the adhesive tape applicator K of FIG. 9A.
Figure 14B:
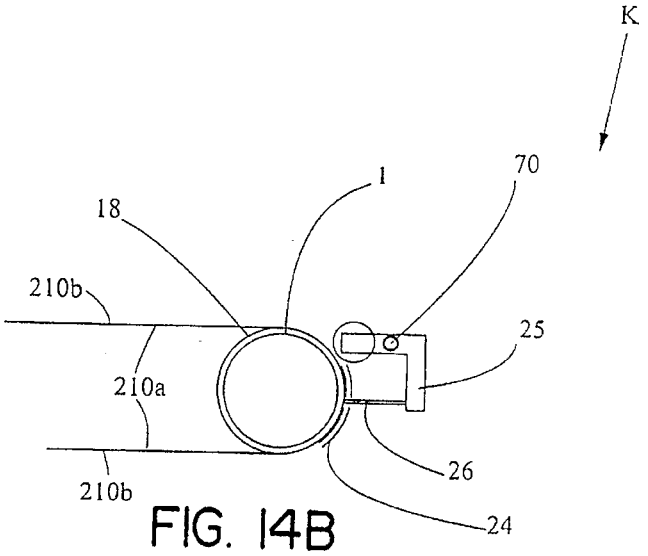
Figure 14C:
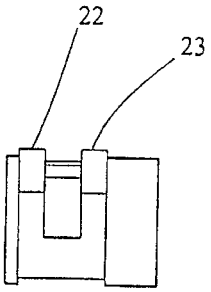
Figure 14D:
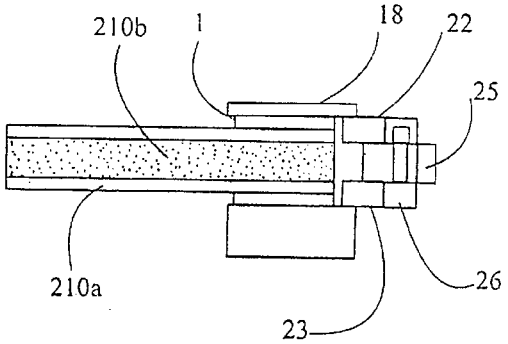

The paper feeding operation will now be discussed with reference to FIGS. 9A, 9B, 9C and 10. The paper is fed into the apparatus, possibly by means of a tray as previously mentioned with respect to FIG. 5, in the direction shown by the arrow in FIG. 9A by means of driven rollers 18 and 18'. While the paper is being fed into the apparatus, two lines are impressed onto the paper by sharp wheels 20 and 21 to form the folding lines G, H for the envelope. At the same time, a strip of double-sided adhesive tape 210 is glued to the edge of the paper along its length by means of device K in the following manner. FIGS. 14A–14D illustrate in greater detail the adhesive application device K, including driven roller 18. The adhesive tape 210*b* with release paper 210*a* on one side, shown in FIGS. 14B and 14D, is fed from a dispenser (not shown) between guide 24 and recess 1, which is part of roller 18, with adhesive side up and release paper down. The release paper or tape 210*a* is wider than the adhesive tape 210*b* to avoid contact between the adhesive tape and the guide rollers 22, 23. While the sheet of paper is being fed into the apparatus, from right to left with respect to FIG. 14*b*, lever 25 is pivoted around pin 70 causing the rollers 22 and 23 to press the edges of the release strip against recess 1, and at the same time withdrawing the knife edge 26 from recess 1 and a slot in guide 24. This causes the adhesive to be pulled by rollers 18 and 22–23 from its dispenser and be drawn along the paper and stuck to it, thus forming a sealing tape covered with release paper on that part of the envelope which will become the sealing flap. While the paper is still being fed into the apparatus before it comes to rest on the folding table 30, the lever 25 is caused to pivot back about pin 70, pushing knife blade 26 into recess 1 through guide 24, cutting the tape and leaving a measured strip of tape stuck to the edge of the paper of just the right length required for the sealing flap and stopping the further pulling of adhesive tape from its dispenser.

The paper continues to move in the apparatus until it comes to rest on a folding table 30, as detailed in FIG. 4.

Figure 9B:
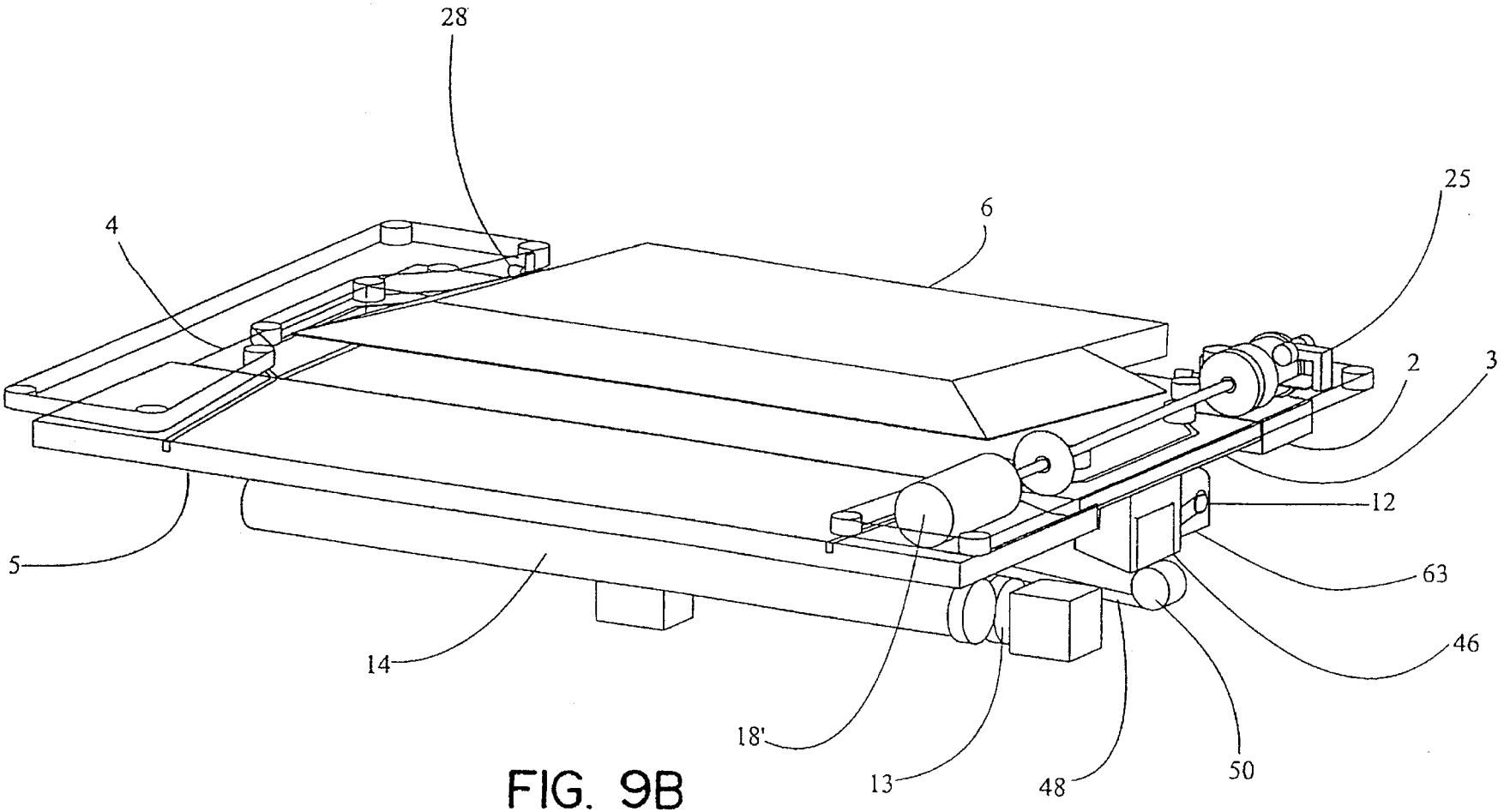
FIG. 9B is a perspective view of the second preferred apparatus of the invention in a position before the production of an envelope.
Figure 9C:
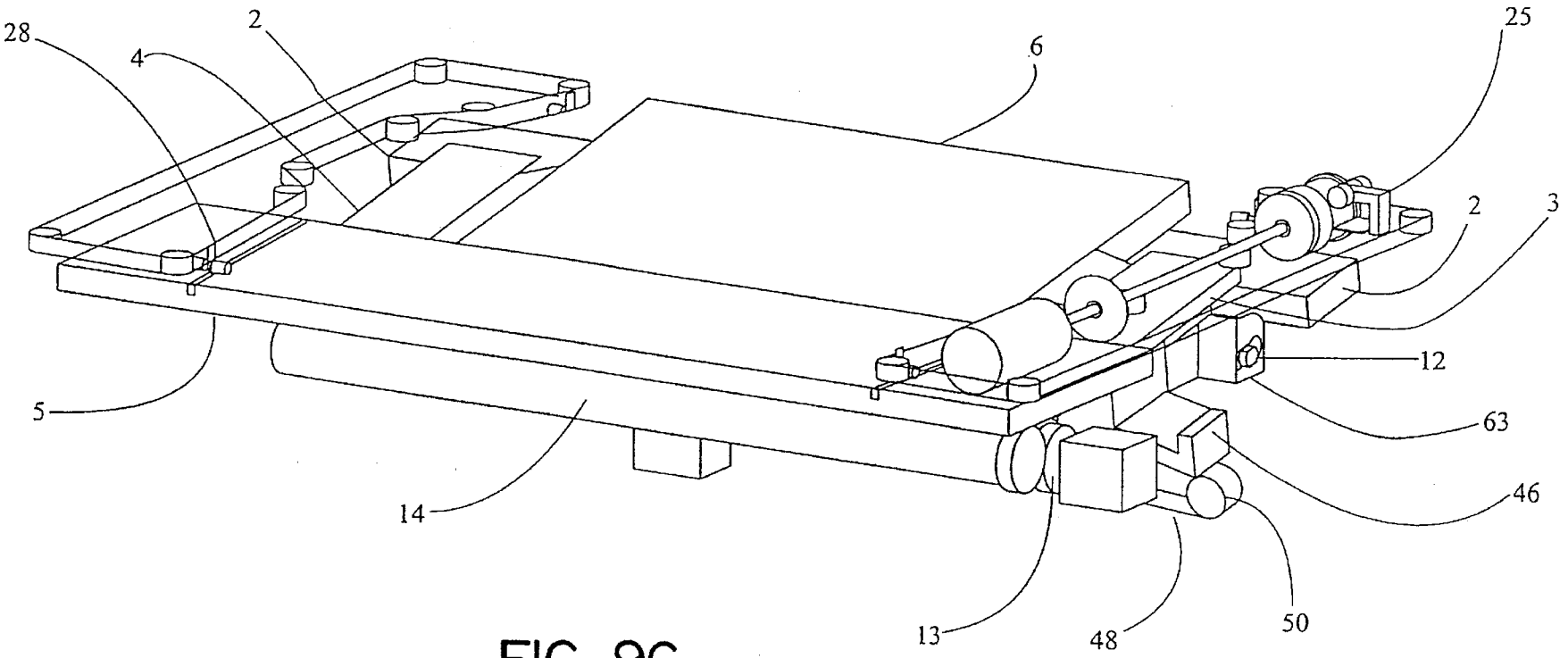
FIG. 9C is a perspective view of the second preferred apparatus of the invention in a position after the production of an envelope.
Figure 11:
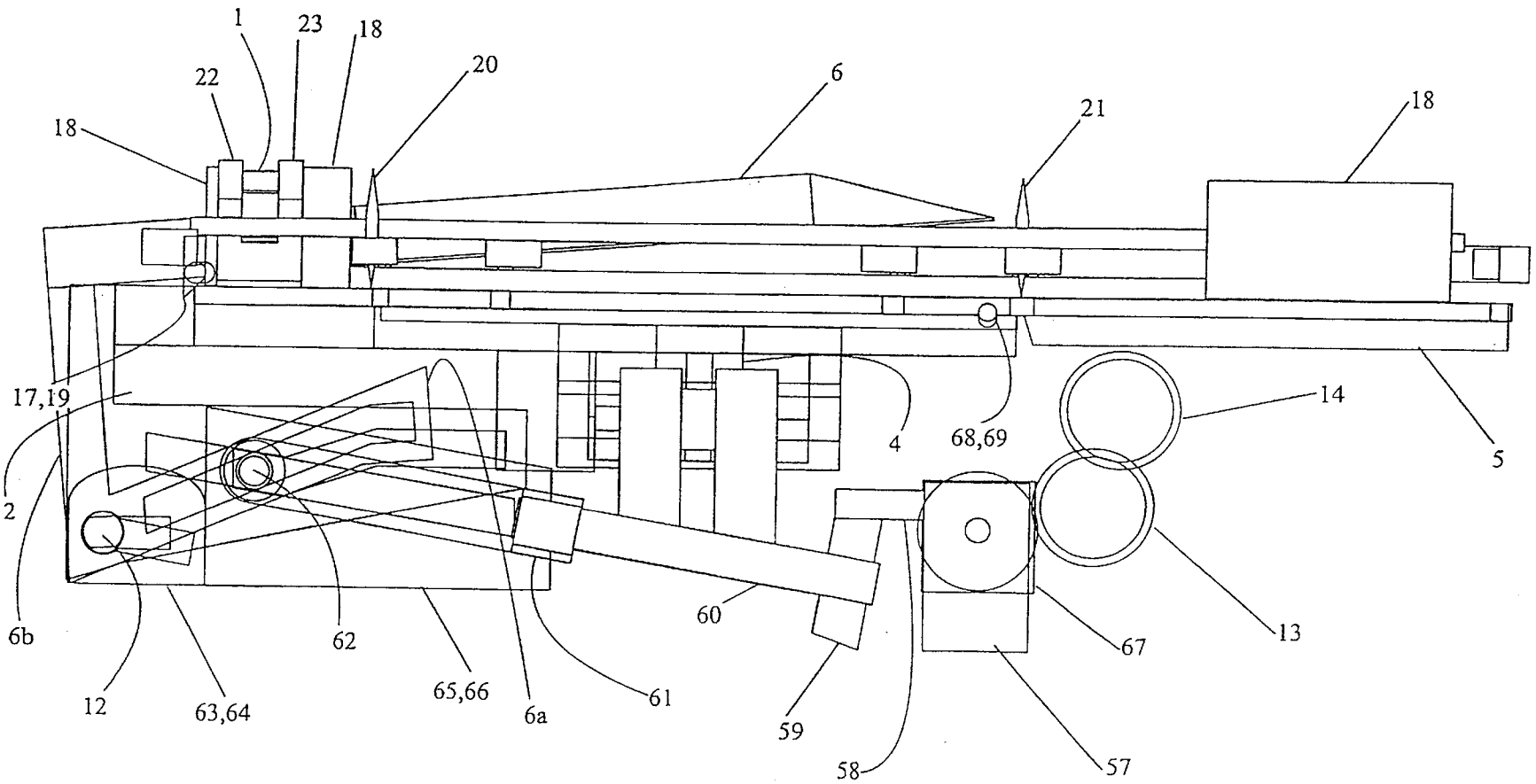
FIG. 11 is a detailed schematic side elevational view of the apparatus shown in FIGS. 9A–9C.
Figure 12A:
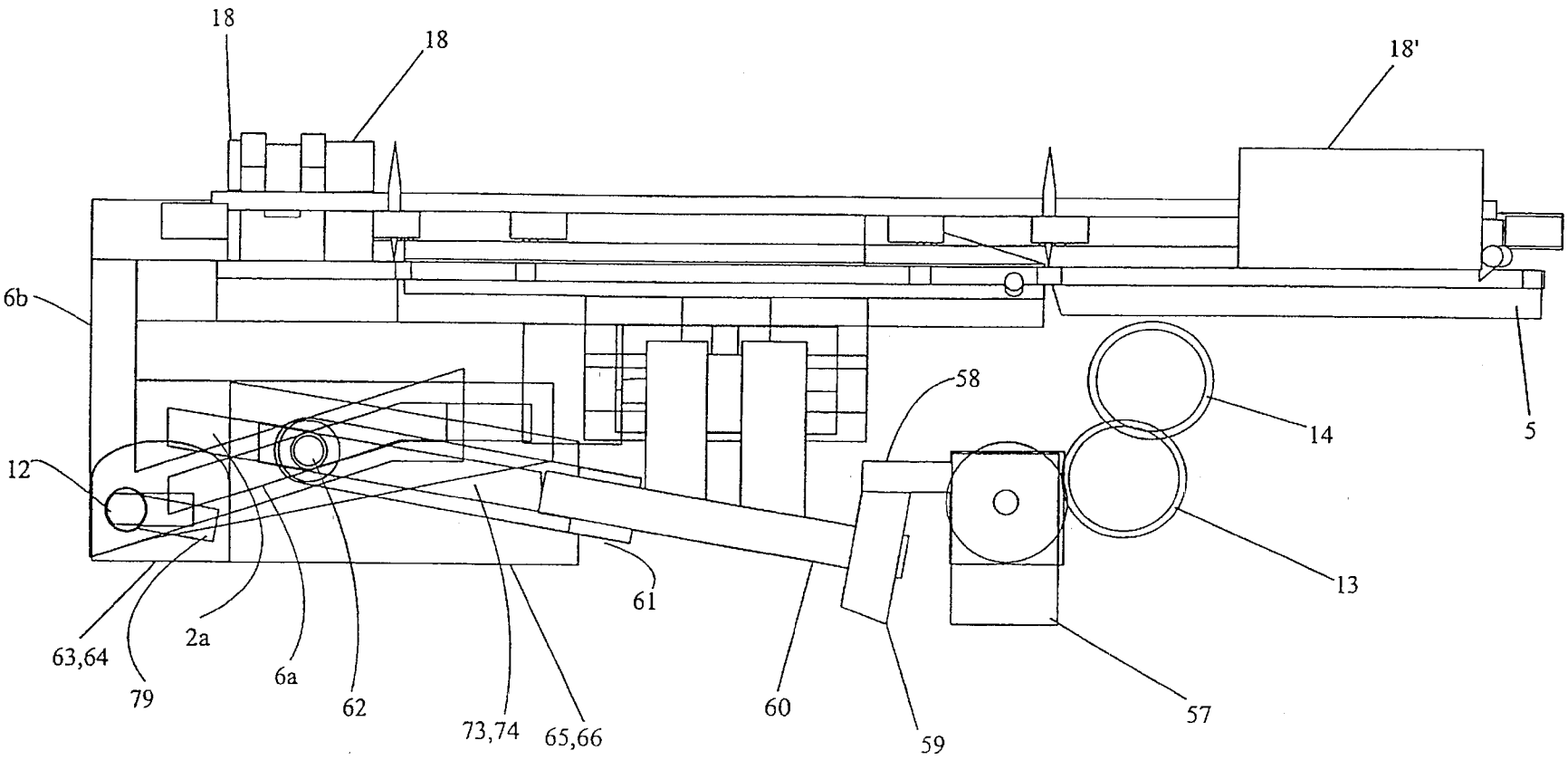
FIGS. 12A, 12B and 12C illustrate in schematic side elevation different stages in the operation of the apparatus of FIGS. 9B and 9C.

With reference to FIG. 9B and 11, e.g., pressure plate 6, which pivots together with axle 12 in the slots of parts 63, 64, is then placed on top of the sheet of paper. As shown in FIG. 12A, pressure plate 6 is then caused to press the paper against the lower base 2. The plate 6 is maneuvered into this position by the motor 57 rotating toothed wheel train 58, 59 and screw shaft 60, linearly pulling fork 61 and shaft 62 towards the motor 57. This linear movement results in pressure plate 6 pivoting together with axle 12 downwards since shaft 62 is forced to move linearly in the slots 73, 74 in parts 65, 66 and the slot 6*a*, within which shaft 62 is also guided, is not parallel to slots 73, 74. The paper is clamped between lower base 2 and pressure plate 6. Two knife blades 17 and 19 are mounted between respective rollers 26, 27 and 28, 29, as illustrated in FIGS. 9A–9C, 10 and 11. The inside rollers 26 and 29 can rotate in both directions, whereas the rollers 27 and 28 are restricted to rotate in only one direction from one side of the apparatus to the other for reasons mentioned below. The rollers begin translational movement on one side, as shown by numerals 26, 27, 28, 29, and end such movement on the other side of the apparatus, as shown by numerals 26', 27', 28', 29'. Knife edges 17 and 19 and the rollers 26, 27, 28 and 29 are connected to moving belts 30 and 31 driven and guided by idler wheels 32–43, 75–78. The knife edges 17 and 19 move along their path, so that their sharp edges are retained in slits 44, 45 located in the various parts of the folding table. The rollers 26, 27, 28 and 29 thus press down on the paper and stabilize the knife position and fix its angle with regard to the folding table. This prevents pulling or pushing the paper while cutting it. At the end of the cutting operation, the knife edges and rollers are removed to a position away from the envelope, as shown in FIG. 9A.

Before continuing with the description of the apparatus with respect to the completion of the formation of the envelope, it is mentioned here that other means and methods are alternatively contemplated for cutting the paper into an envelope blank while the paper is positioned on the folding table. For example, in FIG. 16 a somewhat modified table or support is illustrated having four pivoted blades 750, 760, 770, 780, each of which functions, together with the table 700, somewhat like a common office paper cutter, each being pivoted about a respective pin 790, 800, 810, 820. Each of the blades is appropriately angled smoothly along a measured curve so that the side flaps U, U' are appropriately shaped.

Figure 16:
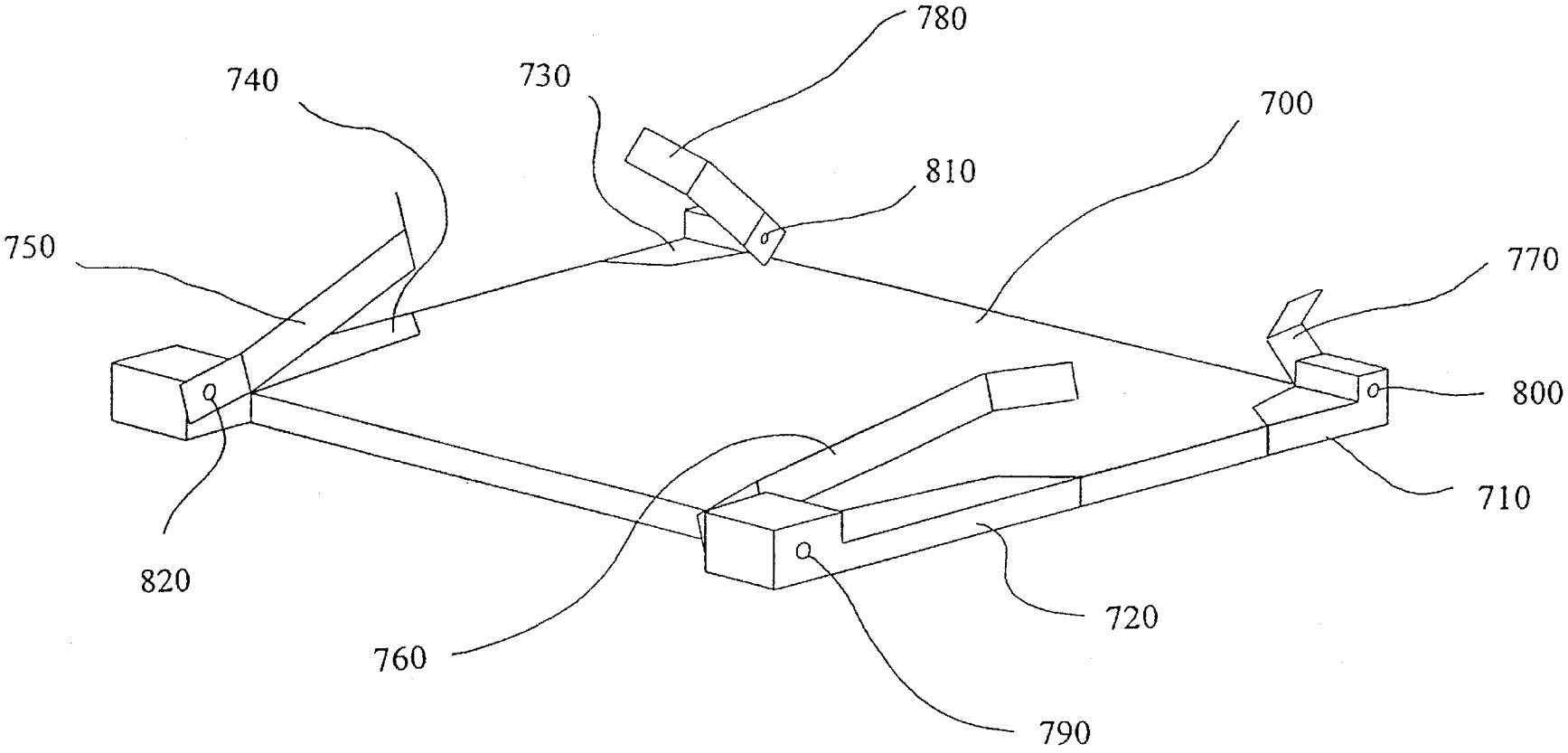
FIGS. 16 and 17 illustrate an alternative device for cutting the paper into an envelope blank.
Figure 17:
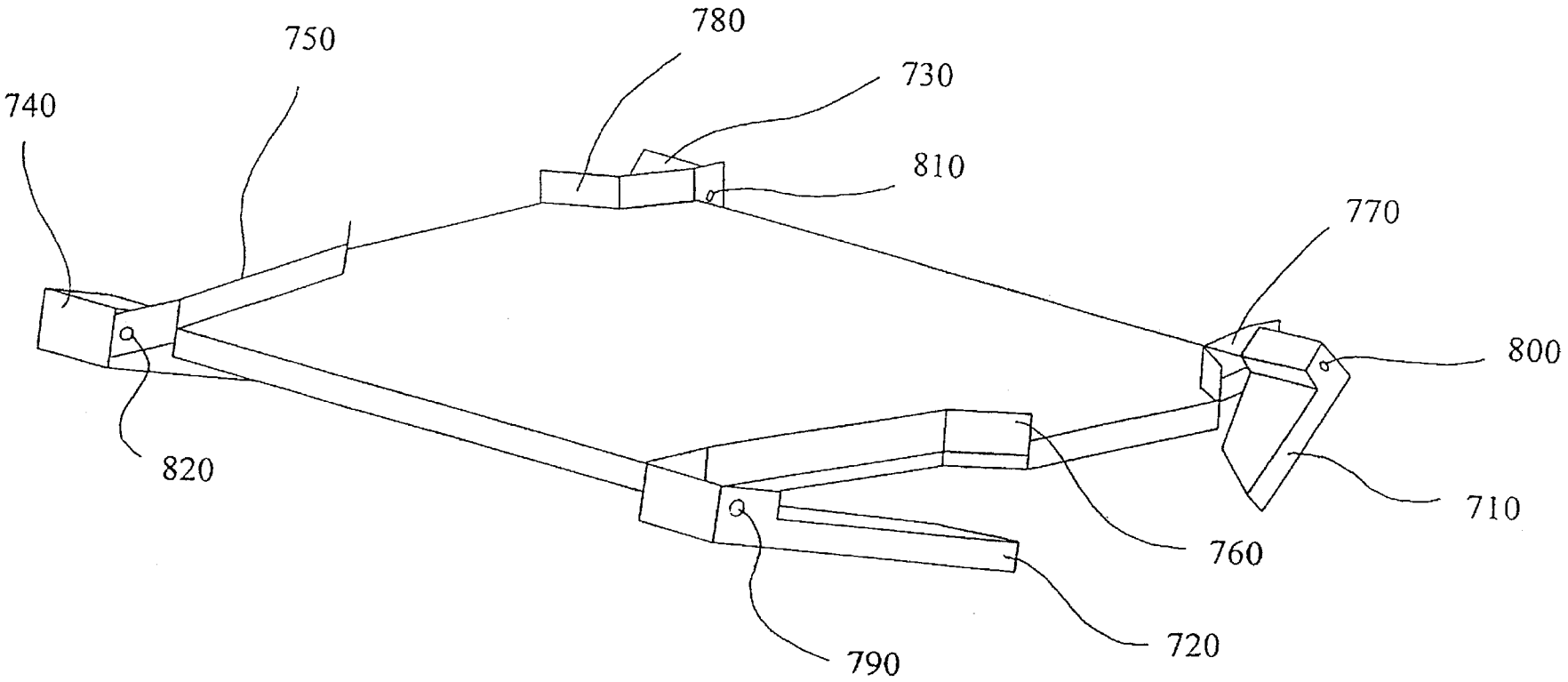

As can be seen in FIGS. 16 and 17, the table 700 includes portions 710, 720, 730, 740 which are mounted for pivoting movement with a respective blade about a respective pin. As the paper is initially fed to the table 700, as shown in FIG. 16, the table portions 710, 720, 730, 740 support the corner portions of the paper. Then, as the blades are caused to be pivoted, by appropriate motor-driven control, e.g., the table portions function to guide the corner portions of the paper, that have been cut away, to an appropriate area for discharge. The table portions 710, 720, 730, 740 are optional and the same shearing method could be accomplished with table 700 illustrated in FIGS. 16 and 17 without containing the table portions 710, 720, 730, 740.

The invention alternatively contemplates other cutting means and methods such as rotating blades, i.e., bladed wheels, a die, such as a cookie-cutter type cutting, or shearing apparatus, including scissor-type shearing, a die, shearing wheels, etc.

In a further alternative, the paper can be cut while moving, whereby the paper passes between the two rollers, which roll with the paper in the direction of movement. Cutting strips suited to the required shape are mounted on the rollers, so that if the rollers were to be spread flat the required planar shape of the paper would be obtained.

This method requires that one of the rollers be capable of spring movement along its axis of rotation. The cutting action is shown schematically in FIGS. 18A–18C.

The direction of rolling of the paper (entry of the paper) is into the plane of the page, or from the plane of the page, towards the reader.

FIG. 18A shows roller A having a shaped protrusion, i.e., a raised portion of the roller, and FIG. 18B shows rollers B and BB having a common axis of rotation. Rollers A and BB are used as normal feeding rollers (for feeding of the paper between them), while roller B, with a shaped indentation, i.e., a recessed portion of the roller, complementary to the shaped protrusion of roller A, can move against a spring along its axis of rotation in the direction shown by the arrow in FIG. 18B.

The cutting shape shown is that of an arch although, of course, other shapes are contemplated, depending upon the shape intended to be cut. The arches in rollers A, B are identical in shape. With respect to FIGS. 18A and 18B, the arch in roller B is rotated through a suitable small angle, so that $\beta>\gamma$.

During the rotation, the paper is cut during a portion of the joint rotation of rollers A, B, BB, between the protrusion and the indentation. Because of the forces created at the cutting point, roller B will be pushed against the spring.

Figure 19A:
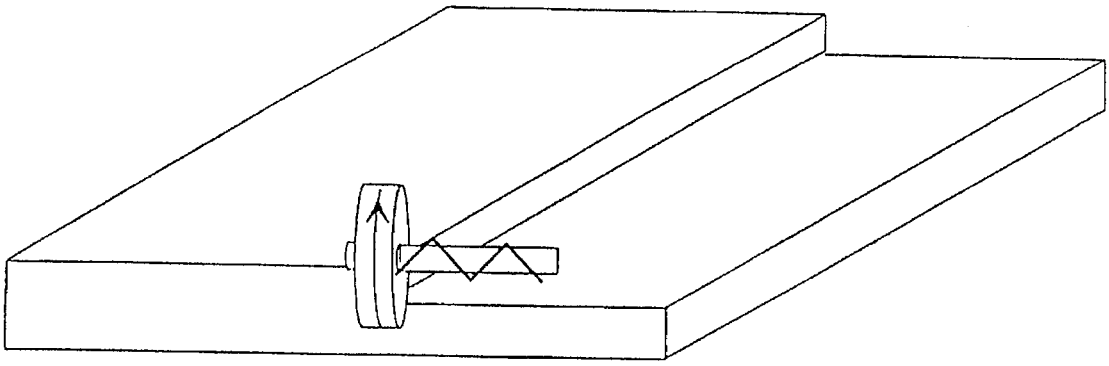
FIGS. 19A and 19B illustrate a further alternative cutting apparatus.
Figure 19B:
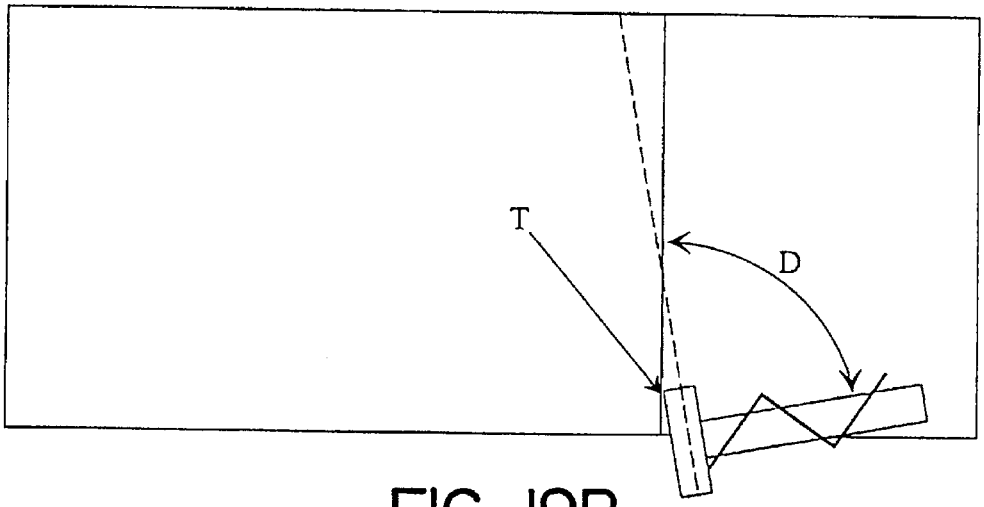

In a still further alternative, cutting can be accomplished with a steel roller or other hard material which rotates near the edge where the cut is to be made, whereby a roller rotates on its axis and can move along its axis of rotation biased against a spring. This method is shown in FIGS. 19A and 19B. The paper is placed on a table having a step—see the perspective view of FIG. 19A (the sheet of paper to be cut does not appear in the drawing). The roller is located so that its axis of rotation inclines from the vertical to the edge of the step shown, so that angle D is smaller than 90 degrees. In this way there is one point of contact between the roller and the edge of the step, marked T.

As the roller progresses in the direction perpendicular to its axis of rotation, or parallel to the edge line, the edge of the step applies a generally perpendicular force which causes the roller to move along its axis of rotation against the spring. The paper is cut along the edge of the step. Rotating the roller around its axis in the direction shown in FIGS. 19A applies force on the paper, bringing it close to the cutting point, similar to cutting with a scissor blade.

The description will now return to the completion of the formation of the envelope. The side flaps of the envelope, which have now been cut to the desired shape, are folded as described with reference to FIG. 7 with respect to the first embodiment. For a more detailed description, reference is now made to FIGS. 12A–12C and 13 of the second embodiment. The sheet of paper lying between the upper pressure plate and folding table 30 has its side flaps lifted by folding means 3 and 4. These folding means 3 and 4 move up the sloped tracks 46 and 47 (see FIG. 13) by means of belts 48 and 49, which are driven by wheel trains 50, 51, 52 and 53, 54, 55 and motor 56 (see also FIG. 9A), all of which are connected to the lower base 2. When the folding means 3, 4 are in the upper position, the side flaps are folded along the sloped edges 26 of the pressure plate 6 (see also FIG. 7).

FIGS. 8A–8D schematically illustrate how the bottom flap T is folded down completely and apply to the second as well as to the first embodiment. Following is a more detailed description of a preferred embodiment for folding and gluing the flaps. The major difference between this second embodiment and the earlier described first embodiment is in the application of adhesive.

Glue is applied to the side flaps U, U' as follows. In the hollow side flap folding means 3, 4 there are provided glue dispensers with ball joint roll-on dispensing heads 68, 69, known in and of themselves, mounted thereon. These roll-on dispensing heads 68, 69 dispense glue only when the ball is pressed and rotated. When the side flaps of the envelope are passed over the roll-on dispenser, glue is spread in a streak thereon. When the envelope is subsequently fed out of the apparatus between rollers 13, 14, the side flaps U, U' are glued to the bottom flap T, resulting in an envelope having side flaps U, U' and bottom flap T glued together with a sealing flap S having an impressed fold line G and a paper release strip of adhesive tape.

Figure 12B:
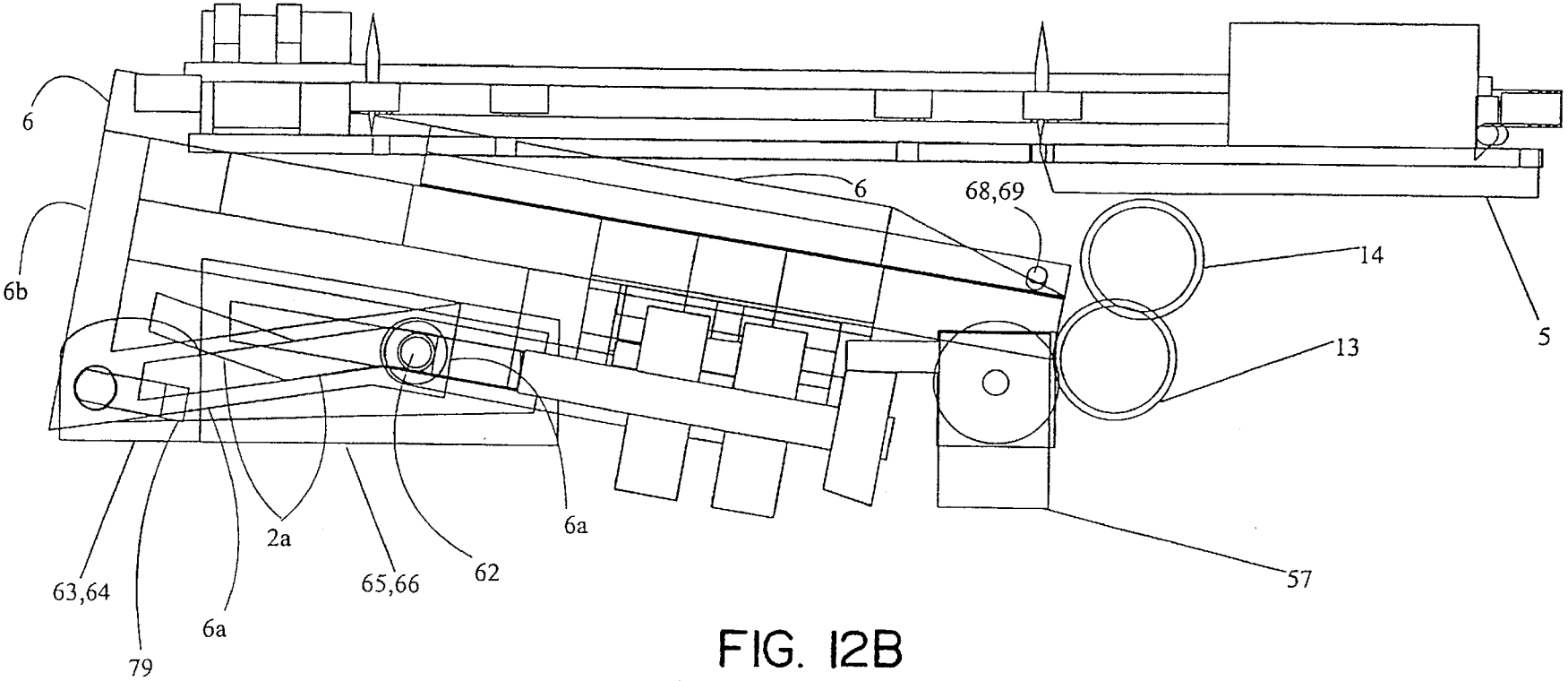
Figure 12C:
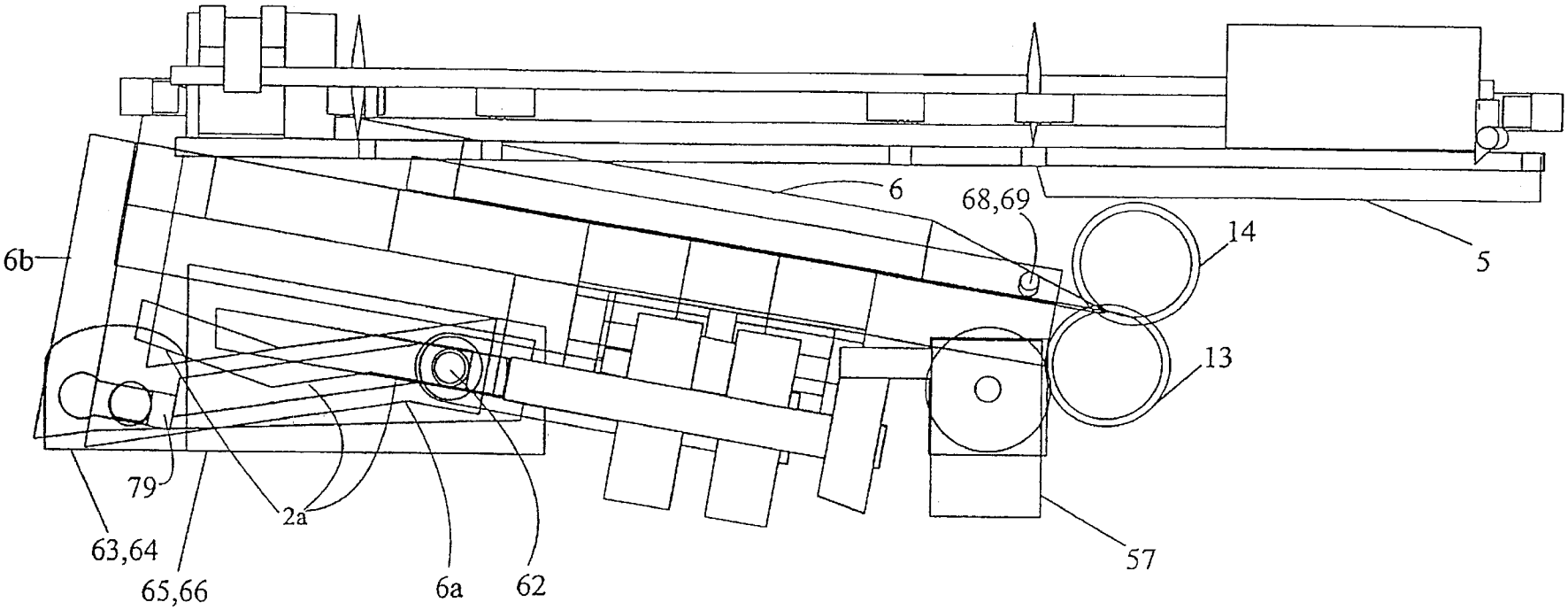
Figure 13:
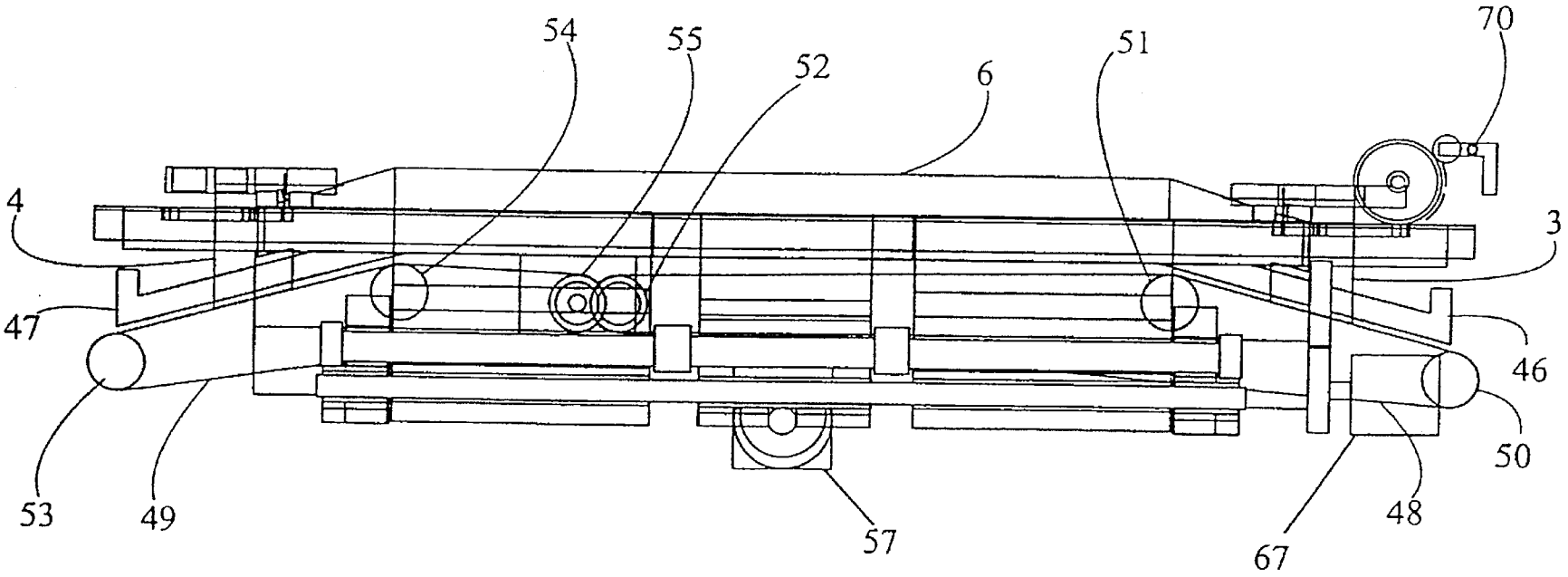
FIG. 13 is a schematic front elevational view of an apparatus as shown in FIG. 9A.

With reference now to FIG. 9A and 12A–12C, the mechanism for folding the bottom flap and discharging the envelope will be described. Although other arrangements of parts could be devised and are contemplated for the present invention, the preferred embodiment illustrated permits the use of a single motor to accomplish the various movements of the pressure plate and the lower plate, for example. Motor 57 rotates the toothed wheel train 58 and 59 and screw shaft 60, pulling fork 61 and shaft 62, attached to fork 61, still closer to the motor 57. Since shaft 62 is forced to move linearly through the slots 73, 74 in parts 65, 66, it forces the slotted arm 6*a* of the upper pressure plate unit 6 and S-shaped slotted arm 2*a* of the lower base 2 to be pulled downward around the slots in parts 63, 64, causing the bottom flap to be folded along the impression line, as illustrated in FIG. 8B. This stage is shown in FIG. 12B.

The motor 57 continues to turn toothed wheel train 58, 59 and screw shaft 60, pulling fork 61 still further closer to it until it reaches a predetermined point. The slots in arm 6*a* are designed so that at this point the upper pressure plate 6 no longer pivots around the slots in parts 63, 64, but rather the upper pressure plate 6 is pulled forward in the direction of the motor 57 by shaft 62 which cannot advance further in the slot of arm 6*a*. This forward pulling of pressure plate 6 results from the fact that axle 12 comprises two flattened surfaces, so that when the axle 12 reaches the appropriate angle, it slides together with the pressure plate and back support 6*b* in the angled slot of parts 63, 64 and slot 79 of part 2 through which passes axle 12. The lower base 2, on the other hand, continues to pivot slightly around axle 12, since the slot in arm 2*a* of lower base 2 allows shaft 62 to advance in the slot. The specific design of the slot in arm 2*a* in lower base 2 and the slot in arm 6*a* in pressure plate 6 enables the shaft 62 to advance the pressure plate 6 and slightly pivot the base 2 in axle 12 so as to increase the space between pressure plate 6 and base 2. One should note that the base 2 is not attached to axis 12 (unlike pressure plate 6) and merely pivots around it. It should be noted also that pressure plate 6 moves linearly, while being biased by springs 71, 72, so that immediately after completing the move forward it springs backwards. This forward linear movement of the pressure plate 6 (as schematically shown above in FIG. 8C) feeds the paper, which is now folded along the impression line between rollers 13, 14 which are rotated by motor 67. The pressure plate 6 is then moved backward (see FIG. 8D) and the flap T is completely folded over the side flaps U, U' using the withdrawn surface of the pressure plate 6 as a table top.

The moving elements of the apparatus then return to their initial positions. The knife edges 17, 19 are returned to their initial position and rollers 27, 28, which do not rotate in this direction as indicated earlier, drag with them the trimmed paper scrap which is dropped into a container (not shown) provided in the apparatus and the apparatus is ready to begin the process all over again.

Although motors and mechanical movements have been described above, specific details of computer and/or electric connections and controls, e.g., for same have been omitted. However, it would be within the ability of those skilled in the art of apparatus that employ such connections and controls, i.e., computers, printers, photocopiers, fax machines, etc., for such connections and computer and/or electric connections and control to be integrated into the disclosed apparatus to accomplish the stated movements and sequences to accomplish the disclosed objectives.

Figure 9D:
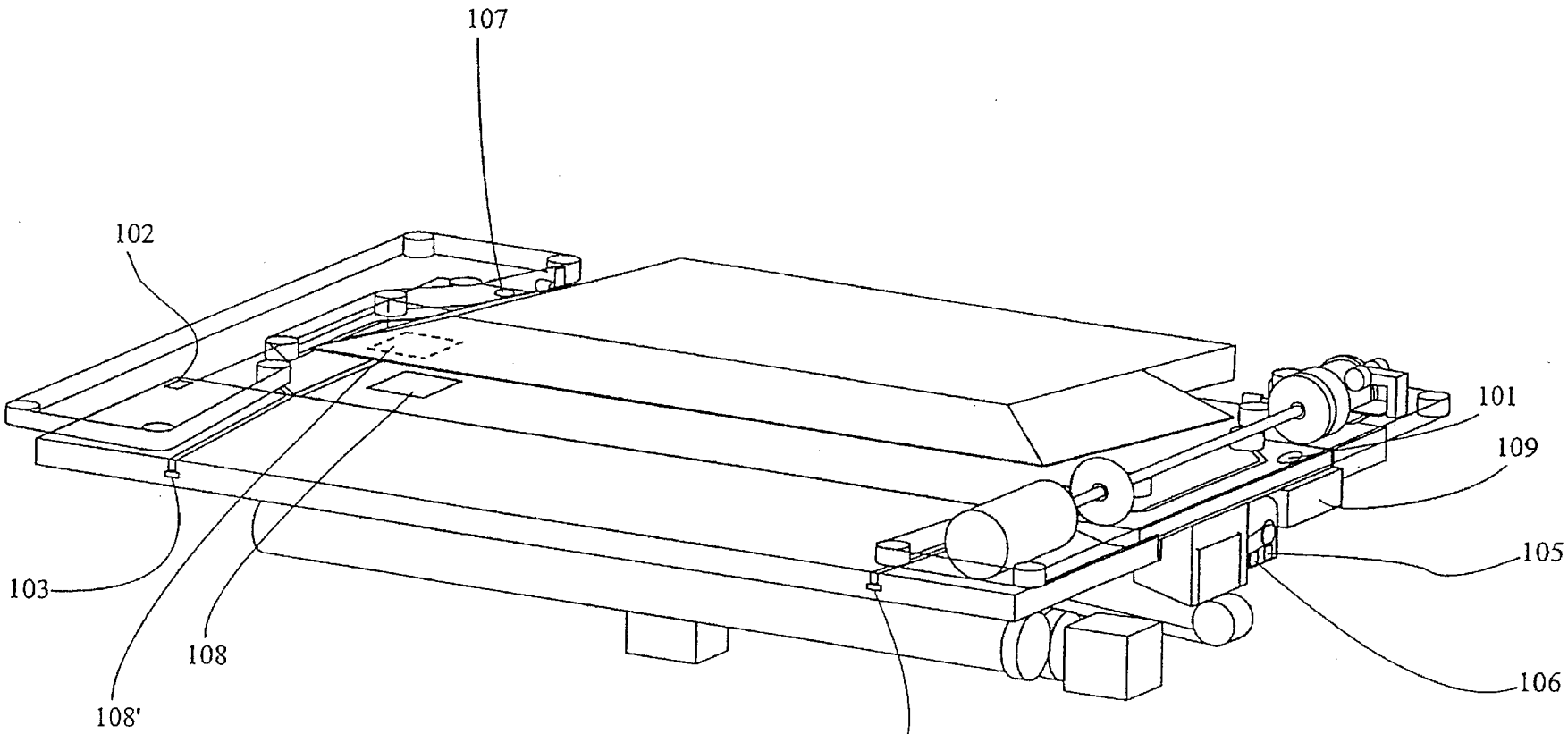
FIG. 9D is a perspective view similar to FIG. 9B, but schematically illustrating sensors for controlling the apparatus.
Figure 10:
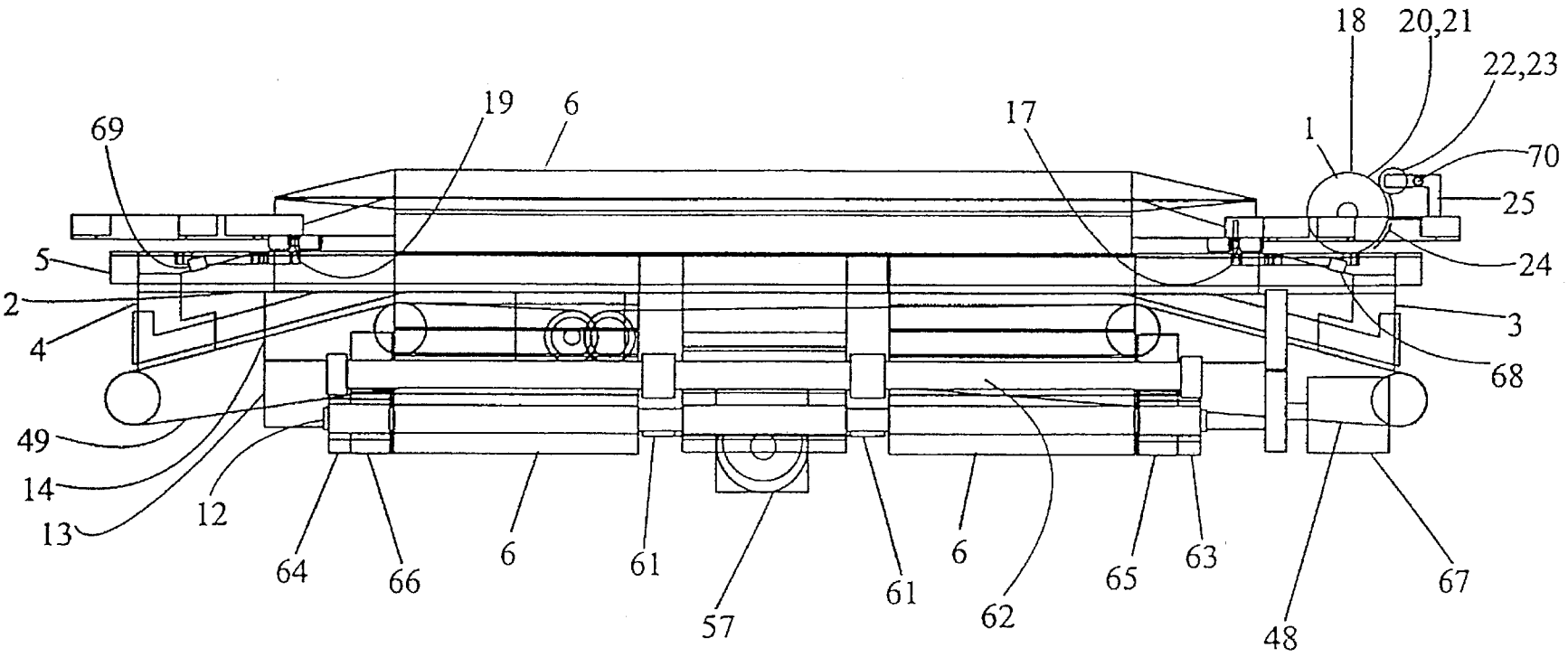
FIG. 10 is a detailed front elevational view of the apparatus of FIGS. 9A–9C.

Alternatively, position sensors of any type suitable for use known to those skilled in the art could be employed as schematically illustrated in FIG. 9D. For example, sensors 101, 102, 103, 104, 105, 106 and 107 are illustrated. Sensor 101 would sense the presence of a sheet of paper, thus initiating the feeding of the sheet to the lower base 2. Sensor 102 would sense the sheet of paper properly positioned on the lower base and terminate the feeding of the sheet and initiate the cutting stage, i.e., movement of the cutting apparatus. Sensors 103, 104 would sense the position of a portion of the cutting apparatus and terminate cutting stage. Sensor 105, an angular sensor, for example, would first determine the end of the downward movement of the plate (before the cutting stage) and, second, sensor 105 would determine the end of the rotation of the upper plate 6 with the lower base 2 and initiate linear movement of the upper plate 6 to fold the lower flap and discharge the envelope. Sensor 106 would determine the end of the linear movement of the plate 6. Finally, sensor 107 would determine the end of the stage whereby waste paper, having been trimmed away by the cutting means, is collected and the cycle of the envelope making apparatus is completed.

Figure 15:
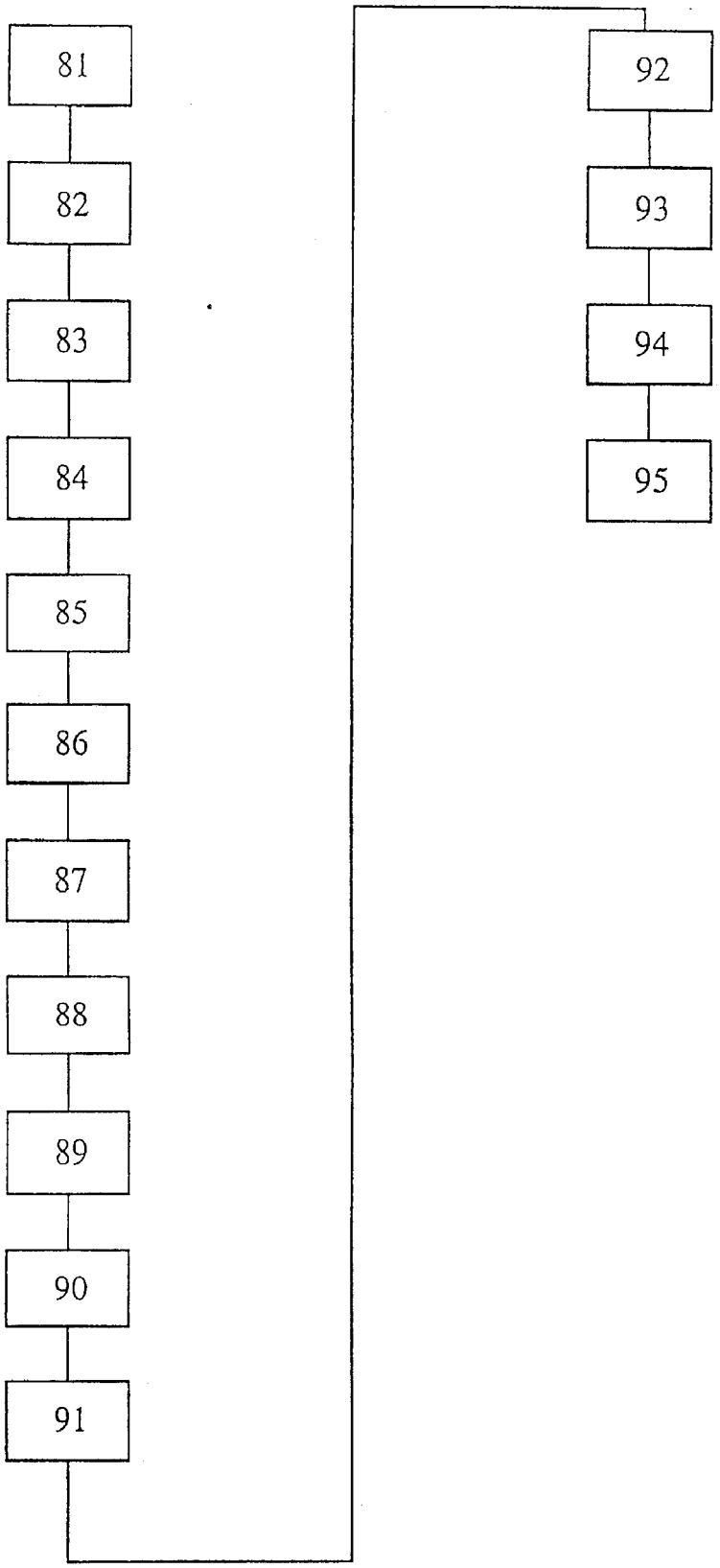
FIG. 15 is a block diagram schematically outlining the method of the invention.

FIG. 15 is a block diagram of the process in accordance with this invention and shows the following order of operations.

80: Paper is fed into the apparatus.

81: A sensing mechanism detects whether the paper is properly inserted. If so, it allows the process to continue.

82: A start button is pressed to begin the apparatus.

83: Feed wheels 18 and rollers 13 and 14 are activated to begin rotating.

84: Paper is transported in the apparatus by feed wheels 18.

85: Fold lines are impressed at this stage.

86: At the same time adhesive strip is applied to the edge of the paper which will serve as a sealing flap.

87: The paper is brought to a stop resting on the folding table.

88: Pressure plate 6 is pivotally lowered onto the sheet of paper, sandwiching it between the pressure plate 6 and lower base 2 (folding table).

89: Knife edges 17 and 19 are advanced by belts 30 and 31 and cut the paper in the desired predetermined shape of the envelope.

90: The pressure plate 6 and lower base 2 are pivotally lowered, lifting the bottom flap on a fold line and the side flap folding means are caused to approach each other, thereby lifting and folding the side flaps.

91: Pressure plate 6 in the pivoted lowered position simultaneously advances linearly over the lower base 2, forcing all the flaps between the rollers 13 and 14 to completely fold the bottom flap.

92: The movement of pressure plate 6 is then reversed and it is withdrawn, while rollers 13 and 14 pull the envelope out of the apparatus while sealing the flaps.

93: When the envelope has completely emerged from the apparatus, pressure plate 6, lower base 2 and side flap folding means return to their original position.

94: The knife edges are returned to their original position, dragging along the trimmed paper scrap with them, the scraps being dropped into a container.

95: The motors shut off and the process can begin again from start.

In FIGS. 20A, 20B and 20C, embodiments of the apparatus according to the invention are shown in association with a printer or a printing apparatus and a computer, such as a personal computer that is typically used for wordprocessing and other purposes. In FIG. 20A, the envelope maker according to the invention is shown as an independent apparatus 220 that can be optionally placed upon a common laser printer 99. The apparatus 220 includes a manual feed 221 on the side of the apparatus for single feeding of sheets for conversion into an envelope according to the invention. Of course, as mentioned above, a paper tray could be adapted for automated sheet feeding by known means. A ready to use envelope exit 222 is positioned at the front of the apparatus 220. A receiving tray could be adapted to receive the envelopes once made and discharged from exit 222.

In FIG. 20B, the envelope maker 230 according to the invention is shown, like that of apparatus 220 above, combined with a common laser printer 99. In this instance, the envelope maker 230 is attached to the top of the laser printer. It is thus adapted to receive directly the sheets normally discharged from the printer in accordance with the normal operation of the printer, as illustrated by means of the arrow in FIG. 20B. The direct receipt of discharged sheets from the printer by the envelope making apparatus could be accomplished by means of an appropriately formed guide, for example, such an appropriately shaped curved plastic piece. Thus, as paper sheet is discharged from the printer 99, after having had an address printed on the center section V of the envelope, for example, the envelope maker 230 directly receives the sheet of paper for feeding to the table top of the lower base 2 for subsequent cutting and folding, etc., and final discharge at exit 232. A manual feed 231, as mentioned in the embodiment above, could be retained in this embodiment. Further, the paper/letter exit 233 for the printer could be located, as shown, at the left side or, for the same task, the letter paper which is not for used in the envelope making procedure, can be recognized as such, in a manner to be described, and to be driven on top of the envelope making apparatus cover 234.

Finally, in the embodiment shown in FIG. 20C, the envelope maker is built into the printer, thereby forming a single unit 240. In such a unit, a paper/letter exit 243 and a separate envelope exit 242 are shown. In this apparatus 240 and with the combination of a common printer with an envelope making apparatus as illustrated in FIG. 20B, by means of the same personal computer and word processing program, for example, the respective file or files for a letter and envelope could be generated and, thereafter, printed by sending an appropriate print command to unit 240, for example, whereby the printed letter is received at exit 243 for insertion into a printed and ready-to-use envelope which is received at exit 242, for example.

Variations of the apparatus and methods described above can of course be introduced, such as for example, dispensing with a start button 82, so that the process is automatically activated once the paper is introduced into the apparatus. Alternatively, if the apparatus is attached directly to a printer, the printer will generally activate the apparatus after the paper has been printed and as it is being fed from the printer into the envelope making apparatus.

Figure 21:
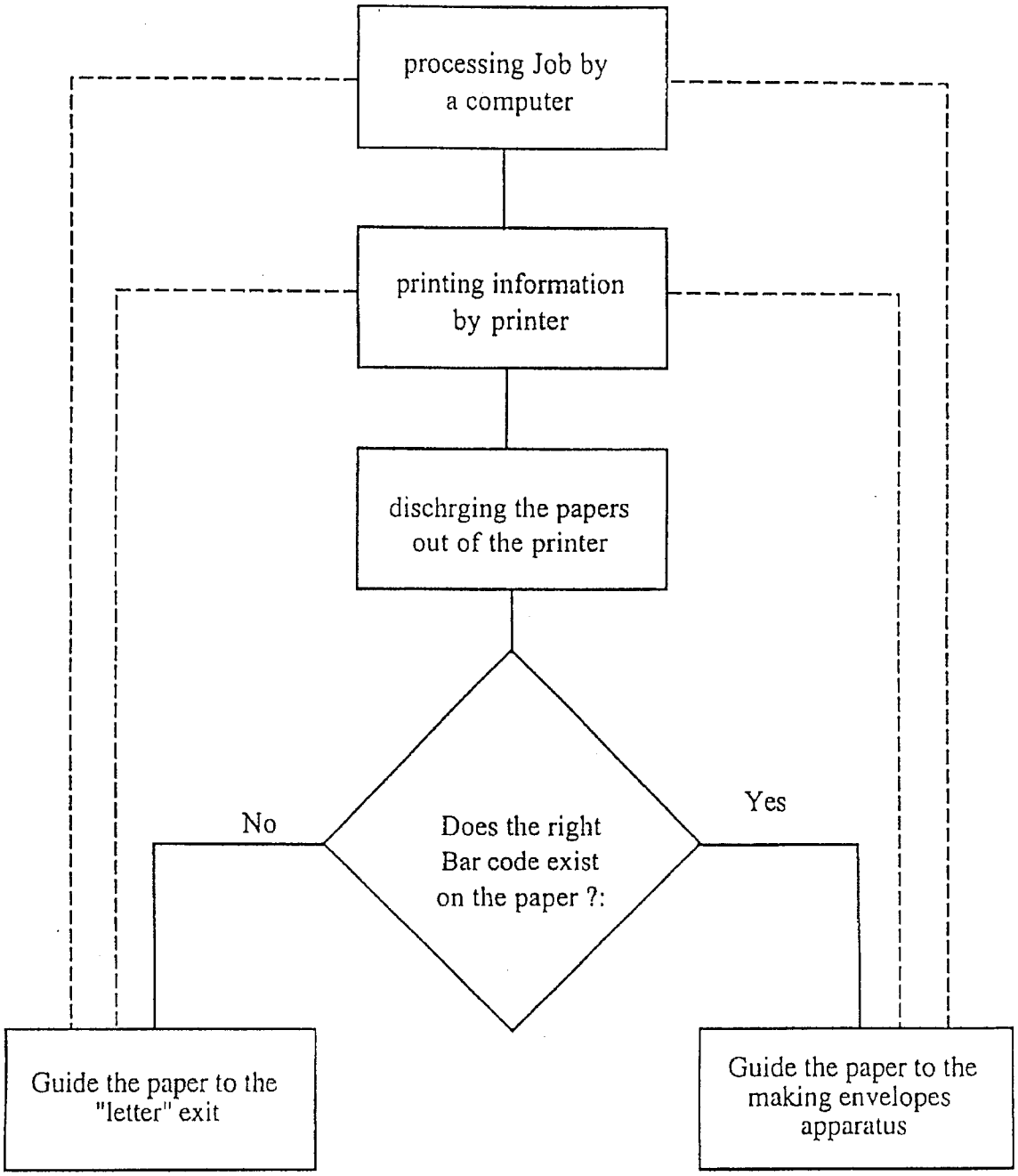
FIG. 21 is a flow chart which schematically illustrates the decision-making process for converting a sheet of paper to an envelope when the apparatus is operably associated with a computer and printer.
Figure 22:
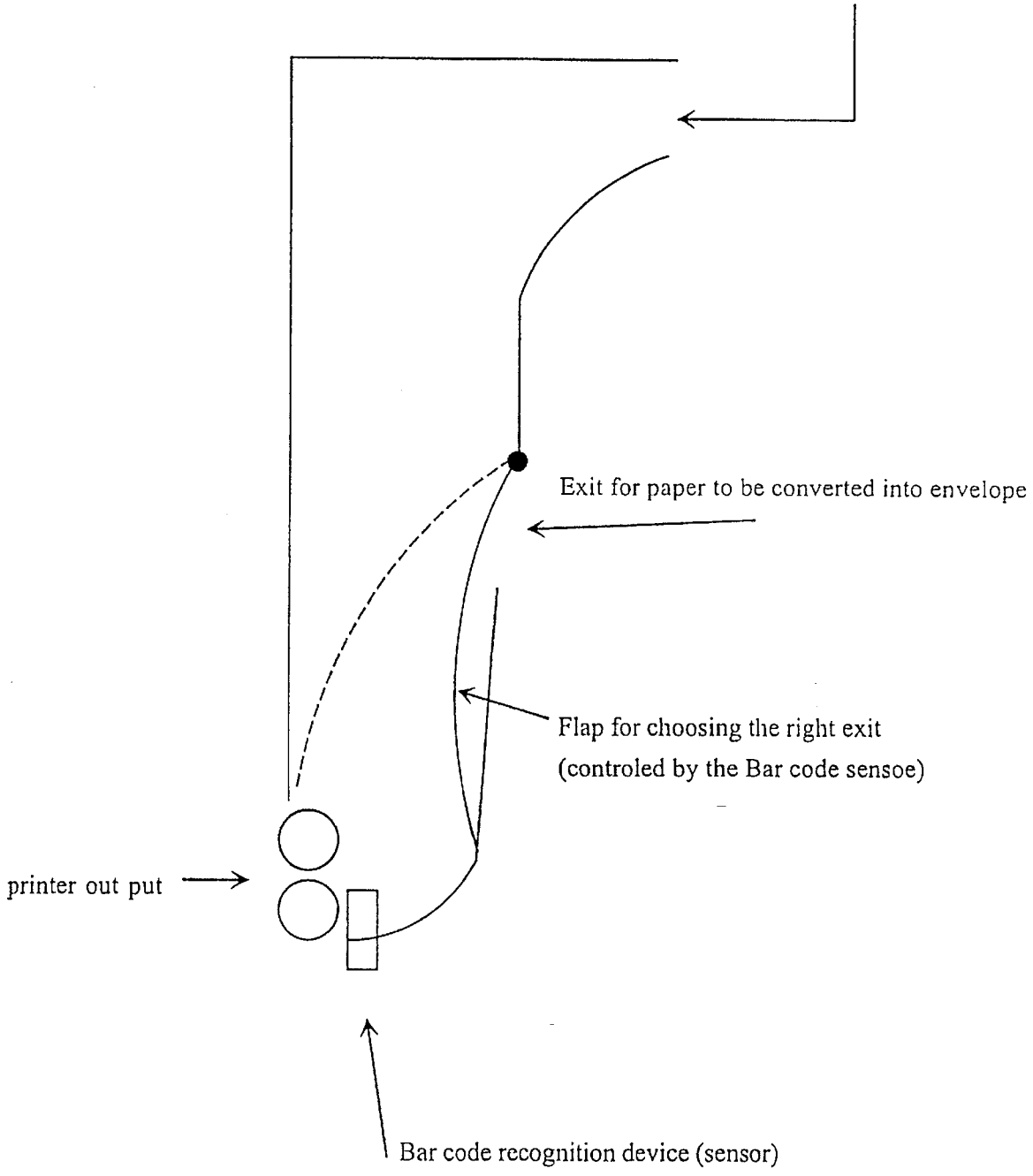
FIG. 22 schematically illustrates an arrangement whereby the decision-making process of FIG. 21 is accomplished.

As schematically illustrated in FIGS. 21 and 22, a still further variation of the apparatus and method of the invention is that of printing of an address, for example, on the center section V of the envelope, i.e., the center section of the sheet of paper to be made into an envelope. This printing would be accompanied by an initial printing of a predetermined bar code on a portion of the sheet of paper that is subsequently trimmed away by means of the aforementioned cutting arrangements.

FIG. 21 shows, in dotted lines, that the path of the paper being discharged by the printer, or from the printing apparatus of the combined printer and envelope maker, could be controlled directly from either the computer or from the printer or printing apparatus. However, in conjunction with the aforementioned use with bar codes, FIG. 21 shows, upon discharge of sheets of paper from the printer or printing apparatus, a determination is made as to whether a bar code, or the correct bar code, appears. If the determination is affirmative, the sheet of paper is fed to the envelope making apparatus; if the determination is negative, he sheet of paper is fed to the "letter" exit of the printer or apparatus.

FIG. 22 schematically illustrates the apparatus of the flow diagram of FIG. 21, whereby sheets of paper are discharged from the printer or printing apparatus. Those having the bar code or correct bar code are introduced to the apparatus of the invention, which includes known means for recognizing or "reading" the bar code. The recognition of the bar code then causes or initiates the feeding mechanism of the envelope making apparatus. Otherwise, the sheet of paper is recognized as a letter, for example, which is not to be converted into an envelope and thereby the letter, for example, is driven in a path not through the envelope making apparatus. Although merely a mark or even a hole in a respective portion of the sheet of paper can be made for sensing as the sheet to be converted to an envelope, the aforementioned use of a bar code permits further derivations and uses in which the sensing of other bar codes could be employed.

The apparatus of this invention may also comprise means 108, 108' for embossing the paper, preferably prior to cutting, as schematically shown in FIG. 9D. As shown, these means would be appropriately attached to the upper plate 6 and lower base 2, whereby the embossing of the paper would be done as the upper plate and lower base are moved together during the envelope making process. Further, the embossing means may be modular in that they can be an optional feature added to the apparatus at any time, the apparatus being designed to have a space and hook-up leads built in for attaching same.

Similarly, the apparatus may be adapted, modularly if desired, to have postage franking means 109, as shown in FIG. 9D, whereby postage could be affixed while the sheet of paper is being initially fed to the apparatus.

The compact desk top envelope maker of this invention may be operated independently or with a printer or computer or both. It can be designed to fit right on top of, or adjacent to a printer, so that a printed sheet of paper coming out of the printer feed directly into the apparatus.

With this invention it is possible to type or print a letter or document of X number of pages and have the X+1 page become the envelope with the address and return address, e.g., fully printed thereon, in center section V, for example, making the letter writing/printing and envelope printing one integrated procedure. Of course, either the first or the last, or in fact, any of the sheets of paper associated with a document created or processed by an associated personal computer, for example, could be used for the envelope.

Other variations of the above-described embodiments and aspects of the invention are also contemplated.

For example, the paper can be fed in various orientations, along the length or width of the paper. Particularly with regard to alternate embodiments of the invention described above in which envelope side flaps are omitted, the sheet of paper could be fed width-wise, rather than length-wise, to be positioned on the lower base 2. Feeding can be carried out with continuous paper, a single sheet or manually by feeding one page after another.

Feeding can be carried out directly from any printer, which prints on the paper before it is folded.

Conventional feeding procedures include feeding a tray stacked with papers cut to a standard or other size. A roller made from a material with a high friction coefficient with paper, which rotates to guide the sheet of paper in turn (sequentially from the top, for example) to its place in the machine (as is common in laser printers and photocopying machines).

Alternatively, feeding of continuous paper with perforations, arranged in a stack like a box, can be used. The paper is pulled into the machine by rollers having extending teeth at their circumference. The teeth grasp the perforated strips located along the edge of the continuous paper. When feeding this type of paper, an accessory for removing the perforated strips must be added (such an accessory is known to exist in several machines).

In addition to the cutting arrangements already disclosed, others are contemplated. For example, a cutting knife blade could be used that moves in any track, with the knife upright or inclined relative to the table top on which the paper is placed. The free knife blade moves under the table top in a groove, while the rest of the knife moves over the table top. In this way paper which is placed on the table is cut when the knife passes in the groove. The cut is therefore in the shape of the groove.

Alternatively, cutting can be accomplished with a steel strip or other shaped hard material. In this method, the paper is placed on a table having a shaped edge. The strip acts as a guillotine against the edge of the table, providing a cutting point all the time between the strip and the edge of the table as it moves along the edge of the table.

Still further, a roller made of a hard material with a sharp edge, which can rotate in any direction is pressed vertically in front of the paper, leaving a cut in it, can be used.

Cutting could also be accomplished with a steel wire or other hard material. In this case, a thin wire moves against the cutting edge in a guillotine movement. The paper would be cut at the cutting edge.

In addition to the folding procedure described, it is possible to fold the sheet of paper in a number of different ways. For example, the paper could be moved on a table whose edges are progressively raised until the flap is perfectly folded (common in industrial folding of envelopes). Alternatively, the paper could be held stationary and the edges of the table could be caused to move in relation to it.

Further, folding could be accomplished by a shaped body pressing the paper, which is held on a matrix suitable for the shaped body.

Still further, the paper could be placed between rollers that roll out paper as it is folded between them. In this method, the paper is introduced by a blunt knife between the rollers, which rotate and exert friction on the paper, pulling (rolling out) the paper via the rollers. This method is common in printshops for folding brochures, pages of books, etc.

It is also contemplated that various alternative methods for gluing could be utilized. For example, commercially available water-based adhesives or hot adhesives, which melt via a heating nozzle, could be used.

Further, a commercially supplied adhesive in the form of a paste or a liquid which can be applied by spreading without heating could be used.

Still further, a two component adhesive could be utilized. One of the components would be liquid, for example, applied by means previously described to the bottom flap T. The other component, such as liquid or powder, for example, would be applied by means previously described to the side flaps U, U'. While the flaps are sealed together, a chemical interaction results in an adhesive material from the two components previously applied, thereby gluing the flaps together.

Still further, an adhesive could be applied by means of an electrostatic powder applied to the sheet of paper by electrostatic attraction and afterwards melted either before or during pressing between the rollers.

Still further, adhesive silicone, which is used in the envelope industry, could be used in the present invention.

Various printing methods could be employed in conjunction with the present invention. For example, the common and well-known laser, dot matrix and ink jet printing could be used. Further, the thermal wax transfer method; the dye cast sublimation method; and the sunprinting method could each be used, as all are common and well-known. The invention could be also employed in conjunction with fax machines in order to fold a received fax into an envelope, thereby maintaining confidentiality.

Other means and methods for forming the needed creases or impressed fold lines can be used, as well. For example, included is a roller made of a hard material, having a sharp edge, which rotates when pushed in the vertical direction in front of the paper, leaving therein an impressed crimp which weakens the resistance of the paper to folding.

Alternatively, the paper could be moved when a roller not made of a hard material but having a sharp edge rotates while being pressed in the vertical position in front of the paper, leaving in it an impressed crimp, which weakens the resistance of the paper to folding.

Further, pressing with a sharp edge of a strip made from a hard material could be utilized. The pressure leaves an impressed crimp in the paper, which weakens the resistance of the paper to folding.

Methods are also contemplated for producing perforations (a series of holes used as a mark for controlled tearing) in the envelope, where found to be needed depending upon the particular style and function intended to be achieved with the envelope. For example, perforations could be formed when moving the sheet of paper when a roller or rollers, with sharp teeth at their circumference, are pressed perpendicularly in front of the paper. The teeth leave a straight line of small holes in the paper for controlled tearing of the paper.

Embossing methods are also contemplated for the envelope and appropriate means could be incorporated in the envelope making machine for making such embossings. For example, an upper relief form in any shape or design is pressed against paper, under which is mounted an opposite lower relief form, the indentations of which fit the protruding part of the upper relief form. This operation causes the paper pressed between the relief forms to be embossed with the design of the relief.

Embossing could also be accomplished as in the previous paragraph, except that the relief forms are cylindrical and are located on rollers, so that the design of the relief is embossed on the paper which is rolled between the rollers.

This application is related to Israeli Patent Application No. 101264, filed on Mar. 17, 1992, the priority of which is claimed under 35 U.S.C. 119, and the disclosure of which is hereby incorporated by reference in its entirety.

Finally, it is to be understood that although the foregoing disclosure relates to preferred embodiments of the invention, the present invention nevertheless is intended to cover all changes and modifications of the embodiments of the invention disclosed herein, which changes modifications do not constitute departures from the spirit and scope of the invention and that the scope of the invention is not limited to the particulars disclosed and extends to all equivalents within the scope of the claims.

What is claimed is:

1. An apparatus for creating envelopes from readily availably sized rectangular sheets of paper, any of said readily availably sized rectangular sheets of paper comprising an envelope to be created, including a central section and a plurality of flap sections, the plurality of flap sections at least including a bottom flap section and a sealing section, said apparatus comprising:

a supporting arrangement for maintaining one of said sheets of paper in a predetermined position;

a feeding arrangement for feeding said one of said sheets of paper to the supporting arrangement;

an adhesive applicator for applying adhesive to at least one of the plurality of flap sections;

an arrangement for folding at least the bottom flap section with respect to the central section;

an arrangement for sealing at least the bottom flap section; and an arrangement for dispensing a created envelope from the apparatus;

whereby the passing of said one of said readily availably sized rectangular sheets of paper through the apparatus results in the conversion of said one of said readily availably sized sheets of paper into an envelope suitable for use with letters printed on another of said readily availably sized rectangular sheets of paper.

2. The apparatus of claim 1, said apparatus further comprising a cutting arrangement for cutting the sheet of paper into a predetermined shape while the paper sheet is maintained in the predetermined position, whereby the cut sheet of paper constitutes the unfolded envelope, the predetermined shape of the unfolded envelope including the central section and a plurality of flap sections to be folded, the plurality of flap sections to be folded at least including the bottom flap section and the sealing flap section.

3. The apparatus of claim 2, wherein the plurality of flap sections further comprises two flap sections and wherein the arrangement for folding comprises a mechanism for folding the bottom flap section and a mechanism for folding the two side flap sections.

4. The apparatus of claim 3, wherein the arrangement for folding the two side flap sections comprise two oppositely disposed members and a mechanism for moving the two oppositely disposed members for engagement with the two side flap sections for folding the two side flap sections toward the central section.

5. The apparatus of claim 3, wherein the arrangement for folding the two side flap sections comprises two oppositely disposed wedge shaped platforms adapted to pivot vertically and reciprocate horizontally.

6. The apparatus of claim 1, wherein the arrangement for folding and the arrangement for sealing comprises an arrangement for simultaneously folding and sealing the side flaps and the bottom flap.

7. The apparatus of claim 1, wherein the feeding arrangement comprises two separate mechanisms for feeding sheets of paper to the supporting arrangement for maintaining the sheet of paper in the predetermined position.

8. The apparatus of claim 1, wherein the supporting arrangement for maintaining the sheet of paper in a predetermined position comprises a folding table upon which the sheet of paper is to be supported and a pressure plate located above the sheet of paper while supported on the folding table, whereby the sheet of paper is held firmly between the folding table and the pressure plate.

9. The apparatus of claim 2, wherein the cutting arrangement comprises a plurality of knife edges and a mechanism for moving the knife edges in a predetermined manner for cutting the sheet of paper, wherein the supporting arrangement for maintaining the sheet of paper in a predetermined position comprises a folding table, the folding table having slits for receiving the knife edges as the knife edges move and cut the sheet of paper into the predetermined shape of the unfolded envelope.

10. The apparatus of claim 1, further comprising a device for impressing fold lines in the sheet of paper.

11. The apparatus of claim 10, wherein the device for impressing fold lines in the sheet of paper comprises a pair of wheels having a generally sharp edge for engagement with the sheet of paper as the sheet of paper is fed to the predetermined position by means of the feeding arrangement.

12. The apparatus of claim 1, wherein the arrangement for folding at least the bottom flap section further comprises a device for dispensing glue.

13. The apparatus of claim 1, wherein the adhesive applicator comprises a device for dispensing double-sided adhesive tape and a device for sticking an adhesive side of the tape to one or more of the flap sections, with release tape on the adhesive tape protecting the adhesive side of the adhesive tape.

14. The apparatus of claim 1, wherein the apparatus comprises means for modularly integrating the apparatus with a printer.

15. The apparatus of claim 14, wherein the means for modularly integrating the apparatus with a printer comprises means for physically connecting the apparatus to a printer, wherein the feeding arrangement for feeding the sheet of paper comprises a device for receiving paper as the sheet of paper is being discharged from the printer and for feeding the same sheet of paper to the apparatus.

16. The apparatus of claim 1, incorporated into a printer for printing paper of said readily available size.

17. The apparatus of claim 1, further comprising means for actuation of a plurality of components aforementioned in accordance with a predetermined operational sequence.

18. The apparatus of claim 1, in combination with a computer, whereby said apparatus is controlled by said computer.

19. The apparatus of claim 1, further comprising an embossing device for embossing the envelope.

20. The apparatus of claim 19, further comprising a postage franking device for affixation of postage to the envelope.

21. The apparatus of claim 1, in combination with a printer in operative association with the apparatus, the apparatus further comprising means for initiating actuation of said feeding arrangement for feeding the sheet of paper, said initiating means comprising means for recognizing information appearing on a predetermined sheet of a plurality of sheets of paper discharged by the printer for feeding to the apparatus.

22. The apparatus of claim 21, wherein the means for recognizing a predetermined sheet of a plurality of sheets of paper discharged by the printer comprises means for recognizing a bar code affixed to the predetermined sheet and for causing the predetermined sheet to be fed to the apparatus.

23. An apparatus for creating envelopes from readily availably sized rectangular sheets of paper, said apparatus comprising:

a supporting arrangement for maintaining one of said sheets of paper in a predetermined position;

a feeding arrangement for feeding said one of said sheets of paper to the supporting arrangement;

a cutting arrangement for cutting said one of said sheets of paper into a predetermined shape while said one of said sheets is maintained in the predetermined position, the predeterminedly shaped sheet of paper comprising an envelope to be created, including a central section and a plurality of flap sections, the plurality of flap sections at least including a bottom flap section and a sealing section;

an adhesive applicator for applying adhesive to at least one of the plurality of flap sections;

an arrangement for folding at least the bottom flap section with respect to the central section;

an arrangement for sealing at least the bottom flap section; and an arrangement for dispensing a created envelope from the apparatus;

whereby the passing of said one of said readily availably sized rectangular sheets of paper through the apparatus results in the conversion of one of said readily availably sized sheets of paper into an envelope suitable for use with letters printed on another of said readily availably sized rectangular sheets of paper.

24. An apparatus for creating envelopes from sheets of paper having a size selected from the group consisting of 8½ inches by 11 inches, 8½ inches by 14 inches, and 21.0 cm by 29.7 cm, any of said sheets of paper comprising an envelope to be created, including a central section and a plurality of flap sections, the plurality of flap sections at least including a bottom flap section and a sealing section, said apparatus comprising:

a supporting arrangement for maintaining one of said sheets of paper in a predetermined position;

a feeding arrangement for feeding said one of said sheets of paper to the supporting arrangement;

an adhesive applicator for applying adhesive to at least one of the plurality of flap sections;

an arrangement for folding at least the bottom flap section with respect to the central section;

an arrangement for sealing at least the bottom flap section; and an arrangement for dispensing a created envelope from the apparatus;

whereby the passing of said one of said sheets of paper through the apparatus results in the conversion of said one of said sheets of paper into an envelope suitable for use with letters printed on another of said sheets of paper.

* * * * *